US007328579B2

(12) United States Patent
Sterk

(10) Patent No.: US 7,328,579 B2
(45) Date of Patent: Feb. 12, 2008

(54) ROTARY PISTON HEAT ENGINE SYSTEM

(75) Inventor: Martin Sterk, Ertingen (DE)

(73) Assignee: SL Trade Marks GmbH, Ertingen (DE)

( * ) Notice: Subject to any disclaimer, the term of this patent is extended or adjusted under 35 U.S.C. 154(b) by 0 days.

(21) Appl. No.: 10/577,316

(22) PCT Filed: Oct. 29, 2003

(86) PCT No.: PCT/DE03/03601

§ 371 (c)(1),
(2), (4) Date: Apr. 28, 2006

(87) PCT Pub. No.: WO2005/045197

PCT Pub. Date: May 19, 2005

(65) Prior Publication Data

US 2007/0036667 A1 Feb. 15, 2007

(51) Int. Cl.
*F01K 1/00* (2006.01)

(52) U.S. Cl. ..... 60/645; 60/670

(58) Field of Classification Search ..... 60/645, 60/670

See application file for complete search history.

(56) References Cited

U.S. PATENT DOCUMENTS 3,588,297 A 6/1971 Crump
3,602,068 A 8/1971 White
5,393,201 A * 2/1995 Okutani et al. ..... 417/16
5,511,874 A * 4/1996 Ikegami et al. ..... 366/100
6,105,543 A 8/2000 Ogawa
7,011,051 B2 * 3/2006 Epshteyn ..... 123/46 R

FOREIGN PATENT DOCUMENTS

| | | |
|---|---|---|
| DE | 39 11 955 A | 10/1990 |
| DE | 41 07 067 A | 9/1992 |
| DE | 197 40 133.3 | 3/1999 |
| DE | 198 14 742 | 1/2000 |
| GB | 473 601 A | 10/1937 |
| WO | WO 02/084078 A | 10/2002 |

OTHER PUBLICATIONS

International Search Report.

* cited by examiner

*Primary Examiner*—Hoang Nguyen
(74) *Attorney, Agent, or Firm*—Collard & Roe, P.C.

(57) ABSTRACT

A rotary piston heat engine system is composed of two units. Each includes two pistons mounted for movement in opposite directions. Each piston is mounted for rotation in a cylinder. The longitudinal axes of the pistons and cylinder are collinear. The pistons are mounted for movement in opposite directions. Effective cylinder displacements are formed in each case between two radial boundary surfaces of the two respective pistons which execute an angular motion relative to each other when the engine is operating. At least one mechanism superimposes a circular motion on the angular motion of the two pistons, and each unit includes a shaft for driving a torque-producing device. The system also includes a heater, a heat storer and a cooler connected to a pipe system by which the inlet ports and outlet ports of the displacements of the cylinders of the units are connected to each other.

18 Claims, 21 Drawing Sheets

30
20
20
20
20
70
70
7
2
60
60
10
10
10
1
1
31
6

Fig. 6 reg. = regenerator
cyl. = cylinder
WG = working gas

| Work cycle | State | Gas path | Cham-ber | Total volume | Pressure | Ports | Temperature | Cyl. displacements Cyl. 100 | Cyl. displacements Cyl. 101 | Working gas |
|---|---|---|---|---|---|---|---|---|---|---|
| 0 | 1 | Expanded WG is in cylinder 3 | 1 | large | low | 0 | medium | large | medium | 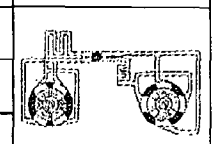 |
| | 1-2 | WG is forced through reg. and cooler (from cyl. 3 to cyl. 3′ | | remains constant | decreases | ↓ 140 131 | isochoric temperature drop | decreases | increases | |
| 1 | 2 | Half of expanded WG is in cyl. 3 and half in cyl. 3′ | 1 and 2 | large | very low | ↓ 140 131 | low | medium | large | 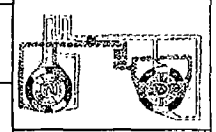 |
| | 2-3 | All of WG is forced into cyl 3′ and pre-compressed | | decreases | .increases | ↓ 140 131 | adiabolic temperature increase | decreases | decreases | |
| 2 | 3 | WG is in cyl. 3′ (precompressed) | 2 | small | medium | 0 | medium | 0 | medium | 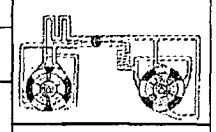 |
| | 3-4 | WG flows from cyl. 3′ to cyl. 3 (through reg. and heater) | | remains constant | increases | ↓ 141 130 | isochoric temperature increase | increases | decreases | |
| 3 | 4 | Pipe connection 141-130 is maintained. WG forces both cylinder displacements apart | 3 | small | maximum pressure | 141 130 | maximum temperature | medium | 0 | 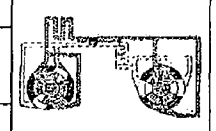 |
| | 4-1 | WG expanded, most thereof remaining in cyl. 3 => work stroke | | increases | decreases | ↓ 140 130 ↑ / 130 | adiabolic temperature drop | increases | increases | |
| 4 | 1 | Expanded WG is in chamber 1 (cyl. 3) | 1 | large | Low | 0 | medium | large | medium | 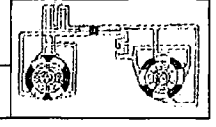 |

Generatore

Unit I
Unit II
TA
TB

Unit II

Unit I

ROTARY PISTON HEAT ENGINE SYSTEM

CROSS REFERENCE TO RELATED APPLICATIONS

Applicant claims priority under 35 U.S.C. §365 of PCT/DE2003/003601 filed Oct. 29, 2003. The international application under PCT article 21(2) was not published in English.

The invention relates to a rotary piston heat engine system composed of two units each comprising two pistons mounted for movement in opposite directions, the pistons being each mounted for rotation in a cylinder, wherein the longitudinal axes of the pistons and cylinder are collinear, and the pistons are mounted for movement in opposite directions, and a plurality of effective cylinder displacements is formed in each case between two radial boundary surfaces of the two respective pistons, which execute an angular motion relative to each other when the engine is operating, and at least one mechanism is provided that superimposes a circular motion on the angular motion of the two pistons, and each unit comprises a drive shaft for a torque-producing device, and heating means, heat storage means and cooling means connected to a pipe system are provided, by means of which the inlet and outlet ports of the displacements of the cylinders of the units are connected to each other.

Wankel engines are examples of rotary piston engines. In these engines, a piston configured, with a plurality of rounded surfaces is mounted in a cylinder, the inner wall of the cylinder not being of circular cross-section but comprising a plurality of concave recesses. The combustion chambers of this engine are therefore formed in each case between the rounded surfaces of the piston and the corresponding recesses of the cylinder. The main disadvantage of the Wankel engine is its complicated construction, which requires considerable effort to manufacture. Another problem is sealing the engine. Even very small ports lead to a reduction in engine performance, to an increase of toxic components in the exhaust, and to an increased fuel and oil consumption.

A rotary piston engine of the aforementioned kind is disclosed in DE 197 40 133.3-15. Such a rotary piston engine comprises a cylinder displacement or cylinder displacement that is greater than that of the Wankel engine and has the advantage that its combustion chambers are easy to seal, to charge and to discharge, and a large proportion of the expansion energy of the combustion gases or the working gases is transformed into kinetic energy.

In addition, so-called Stirling engines are known in the prior art. These are heat engines in which at least one piston is mounted for reciprocation in a cylinder and is moved by gases whose temperature is cyclically altered by means of heating means, heat storage means, and cooling means. The disadvantages of such engines are heat losses due to the cyclic temperature changes of the gases along with the difficulty in sealing the gases due to the high pressures prevailing in the engine. Furthermore, the useful life of such engines is very limited due to the high stress and the consequent rapid wear and tear of the engine components. Moreover, the efficiency of the regenerator poses physical limitations on the efficiency of most of the Stirling engines known in the prior art.

It is an object of the invention to provide a rotary piston heat engine system of the aforementioned type based on the principle of the Stirling engine such that it is possible to adapt it to a number of different operating states, such as various temperature and pressure conditions in the cylinders, thereby expanding the range of possible applications for the system. This is equivalent to the task of developing a rotary piston heat engine system of the aforementioned kind wherein the efficiency under a predetermined operating condition is increased, i.e., the system of the invention enables, on the one hand, more effective operation than in the known systems and, on the other hand, active control of the engine performance.

For a rotary piston engine of the aforementioned kind, this object is achieved by providing a compensating device that balances the positions of the respective pistons in the two units in the event of a possible phase shift in the synchronization of the two units, in order to effect an optimal phase response.

Preferred embodiments of the invention are the subject matter of the subordinate claims.

In the rotary piston heat engine system of the invention, the fact that a compensating device is provided that effects a position compensation of the respective pistons of the two units in the event of a phase shift occurring in the synchronization of the two units in order to effect an optimal phase response, means that a device is provided in which an anti-torque balance between the two units is made possible via a phase shift of the synchronization of the two units. Furthermore, the system of the invention has the important advantage over the prior art that, in a predetermined manner, a discretionary positioning of the angle of rotation of a respective piston in the units is possible, in order to optimize the efficiency or the performance of the engine system.

In the following, the construction and function of the rotary piston heat engine system of the invention is explained, followed by an explanation of the construction and function of the compensating device claimed.

The engine of the invention has a more simple construction than conventional Stirling motors. Parts such as valves, camshafts, or crankshafts are not needed to control the timing gear wheel. All major components of the engine have cylindrical surfaces that are easy to grind and that can be easily and economically produced with great precision. Sealing the engine likewise presents no problems. An almost perfect seal can be achieved with standard sealing elements. It is thus possible to reduce production costs considerably. Other advantages of the engine are its compact dimensions, and an especially effective design of a regenerator, of the gas flow and of the possibilities of optimization via alterations in stroke speed, and specific sequence interferences.

The engine of the invention is a cyclically-operating, rotary piston engine that can be selectively equipped with a plurality of working chambers.

According to a preferred embodiment of the rotary piston engine of the invention, two units comprising pistons, cylinders and cylinder end faces are connected to each other by a control mechanism.

In each unit of the engine of the invention, there are preferably two pistons, each provided with two piston vanes, wherein four working chambers are formed between the respective boundary surfaces of the total of four piston vanes of each unit, and four double working processes take place during one revolution of the working shaft.

In the engine of the invention, different weights of the pistons are preferably compensated for by cut-outs and/or additional weights on the pistons and/or the gear wheels.

This reduces the operating noise of the engine as well as the stress on the components.

In the rotary piston heat engine of the invention, the axle of one piston in each unit is preferably embodied as a solid rod and the axle of the other piston in each unit is embodied as a hollow rod, the inside diameter of the hollow rod being dimensioned so that the solid rod of the one piston is collinearly aligned therewith and mounted for displacement therein. This results in a simple and robust way of producing mutual displaceability of the two pistons with collinear axles.

The mechanism for superimposing a circular motion on the angular motion (approximately 60°) of the pistons preferably comprises six oval gear wheels, the principal axes of the gear wheels being disposed one above the other in pairs. In each case there are preferably two superposed oval gear wheels allocated to each cylinder, and the two other superposed oval gear wheels are allocated to a working shaft for outputting the engine power. In each case, the four oval gear wheels of the cylinder are thus connected to corresponding oval gear wheels on the output shaft, the corresponding oval gear wheels in each case being mounted perpendicularly thereon. It is especially advantageous if the axle of one of the pistons is connected to a first oval gear wheel and the axle of the other piston is connected to a second oval gear wheel, the oval gear wheels being disposed collinearly with their principal axes being superposed. The first and second oval gear wheels are preferably connected to each other via third and fourth oval gear wheels, wherein the third and fourth oval gear wheels are collinearly mounted on an axle, the principal axes of the third and fourth oval gear wheels being superposed.

A plurality of inlet and outlet ports is preferably allocated to each of the units.

The two cylinders of the engine of the invention preferably comprise differently dimensioned and differently disposed cylinder wall sections between the respective inlet and outlet ports. In a first cylinder of the engine of the invention, a cylinder wall encompassing only a few angular °s is preferably provided between a first inlet port of a pair of inlet ports and a first adjacent outlet port of a pair of outlet ports, and a cylinder wall encompassing approximately 60 angular °s is provided between the same inlet port of the pair of inlet ports and another outlet port of the pair of outlet ports.

Furthermore, in a second cylinder of the engine of the invention, a cylinder wall encompassing approximately 30 angular °s is preferably provided between a first inlet port of a pair of inlet ports and a first adjacent outlet port of a pair of outlet ports, and a cylinder wall likewise encompassing approximately 30 angular °s is provided between the same inlet port of the pair of inlet ports and another outlet port of the pair of outlet ports.

The asymmetry between the inlet and outlet ports of the first cylinder and the second cylinder in the engine of the invention results in timely transport of the working gas from one cylinder to the other. This process generates the work output of the engine.

The respective angular position of the ports is preferably such that in each case it coincides with the position of the respective combustion chamber, the combustion chamber being formed by the respective boundary surfaces of the respective sections of the piston vanes, in order to effect timely charging and discharging of the working chambers.

The boundary surfaces of the cylinders are in each case preferably aligned in a straight line, the adjacent parts of opposing piston boundary surfaces being equally spaced from each other.

The straight-line configuration of the inlet port and the outlet port, in conjunction with the straight-line configuration of the piston boundary surfaces, effects an angular motion of the pistons within the cylinder, wherein the respective working chambers expand in such a way that the first piston in a first stroke swings forward by approximately 60°, and the second piston pivots swings forward by approximately 120°, whereupon in a second stroke the first piston swings forward by approximately 120° and the second piston swings forward by approximately 60°.

This swinging behavior is accompanied by a configuration of the respective first and second oval gear wheels in which the ratio of the length of the longitudinal axis to the length of the transverse axis of each one of the gear wheels is approximately 1.7:1. Alternatively, it is possible for one pair of gear wheels to have a circular configuration and to compensate for this by providing the other pair of gear wheels with an approximately 3.5:1 ratio of the length of the longitudinal axis to the length of the transverse axis.

When it is desired to alter the angular stroke range, it is necessary to change the elliptical configuration of the gear wheels, as well as to adjust the inlet and outlet ports to the piston boundary surfaces.

In the engine of the invention, the first and second oval gear wheels are in each case connected to each other by means of third and fourth oval gear wheels, the third and fourth gear wheels being collinearly mounted on an axle with their principal axes being superposed.

In the engine of the invention, the piston boundary surfaces exhibit a straight-line configuration so that in each case adjacent components of opposing piston boundary surfaces are equally spaced from each other.

In the engine of the invention, the respective angular position of the inlet ports is preferably such that it coincides with the position of the respective cylinder displacement, the displacement being formed by the respective boundary surfaces of the respective sections of the piston vanes, in order to effect timely charging of the working chambers.

In the engine of the invention, the respective angular position of the outlet ports is preferably disposed such that it in each case coincides with the position of the respective cylinder displacement, the displacement being formed by the respective boundary surfaces of the respective sections of the piston vanes, in order to effect timely discharge of the working chambers.

In the engine of the invention, for example, the four pistons mounted for movement in opposite directions are preferably mounted for rotation in two different cylinders.

In the engine of the invention, it is advantageous to provide a by-pass pipe between a hot pipe and a cold pipe in order to produce an effective and rapid decrease or increase in output corresponding to a decrease or increase in power of the engine, the by-pass pipe being activated or deactivated by a valve mechanism.

According to another preferred embodiment of the engine of the invention, a pipe connection between the cylinder displacements is embodied as a dual circuit system.

The hot pipe and the cold pipe of the pipe system can be embodied as separate units in the engine of the invention.

The engine of the invention can be designed as a valve-controlled Stirling engine, without additional components.

In the engine of the invention, the working gas preferably always flows in the same direction in any one pipe section.

The engine of the invention can be used as a heat pump when it is supplied with mechanical energy.

Furthermore, the engine of the invention can also be used as a refrigerating machine when it is supplied with mechanical energy.

The engine of the invention can also be used as a Vuilleumier cycle machine.

The design and function of preferred embodiments of the compensating device of the invention are explained below.

According to a first preferred embodiment of the system of the invention, the compensating device can be adjusted discretely. The advantage of this is that a phase change of the respective pistons of the two units can be realized using simple structural means. To do so, the compensating device can, for example, be embodied as a toothed belt guided around the shafts of the two units, the belt being mounted for displacement by one or more teeth to effect compensation.

The compensating device is preferably embodied as an anchoring system, in which the respective drive shafts driving one of the torque-producing devices of the units are mounted in various fixed positions, wherein in each of the positions, the gear wheels of the torque-producing device mesh with the corresponding gear wheels on the shafts. The anchoring mechanism is preferably embodied as a gearbox or a retainer plate, in which the respective drive shafts driving one of the torque-producing devices of the units are mounted in various fixed positions, wherein, in each of the positions, the gear wheels of the torque-producing device mesh with the corresponding gear wheels on the shafts.

The respective drive shafts driving one of the torque-producing devices of the units are preferably aligned relative to each other at a fixed angle of 135° or 125°, wherein a respective bore hole A, A' or B, B' is allocated to each shaft for each of the angular configurations.

According to a second preferred embodiment of the system of the invention, the compensating device can be adjusted continuously. This enables a very rapid phase alteration of the respective pistons of the two units and a corresponding change in output of the system of the invention. Furthermore, engine braking is possible as a result, in that a sufficiently large mis-phase displacement is induced by means of a controllable adjustment system.

In this embodiment, the compensating device is preferably embodied as two displaceable rollers disposed between the two torque-producing devices of the two units and driveably connected via a toothed belt to the torque-producing devices, wherein the displaceable rollers are reciprocately displaceable in mutually variable spacings in a direction normal to the line of connection of the torque-producing devices. The two displaceable rollers can be embodied, in particular, as excentric rollers.

It is preferable that a first inlet port of a diametrically opposed first pair of inlet ports of a first cylinder and a first outlet port of a diametrically opposed first pair of outlet ports of the first cylinder are at a distance of from 1° to 5° from each other and a second inlet port of the diametrically opposed first pair of inlet ports and a second outlet port of the diametrically opposed first pair of outlet ports are separated from each other by an angle of approximately 55° to 95°. This enables the system of the invention to operate with optimum energy efficiency.

It is especially preferable if a first inlet port of the first diametrically opposed first pair of inlet ports and a first outlet port of the first diametrically opposed first pair of outlet ports are separated from each other by 4°.

It is likewise especially preferable if a second inlet port of the first diametrically opposed first pair of inlet ports and a second outlet port of the first diametrically opposed first pair of outlet ports are separated from each other by an angle of 77°.

It is likewise preferable if a first inlet port of a diametrically opposed second pair of inlet ports of a second cylinder and a first outlet port of a diametrically opposed second pair of outlet ports of the second cylinder are separated from each other by an angle of approximately 25° to 45° and a second inlet port of the diametrically opposed second pair of inlet ports and a second outlet port of the diametrically opposed second pair of outlet ports are separated from each other by an angle of approximately 30° to 60°, in order to enable the system of the invention to operate with optimum energy efficiency.

It is especially preferable if a first inlet port of the diametrically opposed second pair of inlet ports and a first outlet port of the diametrically opposed second pair of outlet ports are separated from each other by an angle of approximately 34°.

It is likewise particularly preferable if a second inlet port of the diametrically opposed second pair of inlet ports and a second outlet port of the diametrically opposed second pair of outlet ports are separated from each other by an angle of approximately 47°.

According to an important preferred embodiment of the system of the invention, all inlet ports and outlet ports are disposed in the cylinder head of a given cylinder.

According to another preferred embodiment of the system of the invention, the two units are disposed such that a part of the mechanism from which the torque of the rotary piston engine is outputted is driven by both units, and a heating system, a heat storage system and a cooling system in conjunction with a pipe system are provided, via which pipe system the inlet ports and outlet ports of the cylinder displacements of at least one of the cylinders of the units are connected to each other.

The rotary piston heat engine system of the invention is especially suitable for use as a heat pump or a refrigerating unit when rotational energy is supplied to the torque-producing devices.

The rotary piston heat engine system of the invention is explained below with reference to preferred embodiments shown in the figures of the drawings, in which:

FIG. 1 is a cross sectional view of a preferred embodiment of the rotary piston heat engine system of the invention, including heat exchangers and pipe connections, in a first operating position.

FIG. 1*a* shows the embodiment of the rotary piston heat engine system of the invention shown in FIG. 1 in another operating position, also in a cross sectional view;

FIG. 2 is a partially cut-away oblique top view of the cylinders of the rotary piston heat engine system shown in FIG. 1;

FIG. 2*a* is an oblique bottom view of a first piston half of a cylinder of the rotary piston heat engine system shown in FIG. 1;

FIG. 2*b* is an oblique top view of a second piston half of a cylinder of the rotary piston heat engine system shown in FIG. 1;

Figure 1:
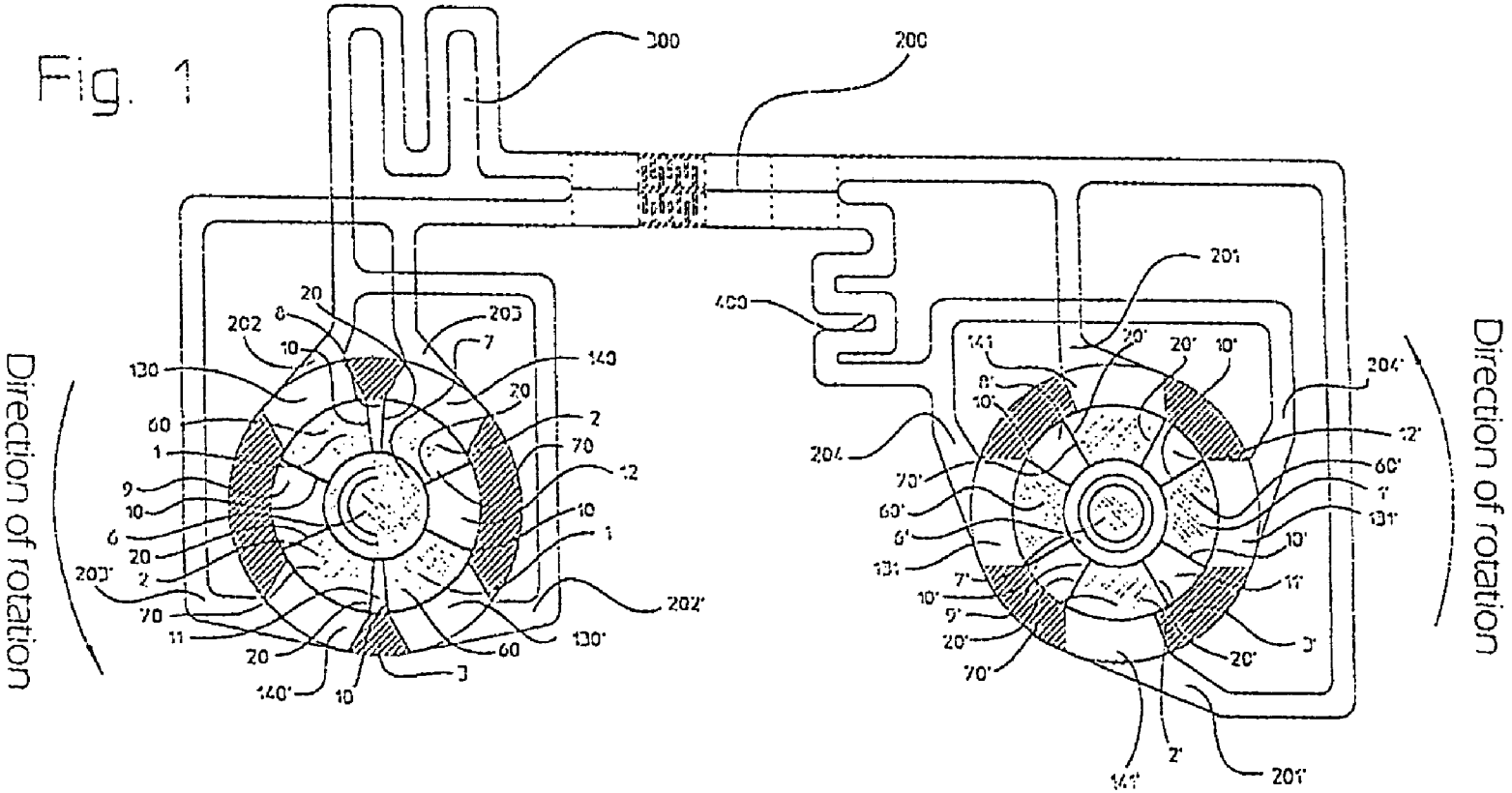
Figure 4:
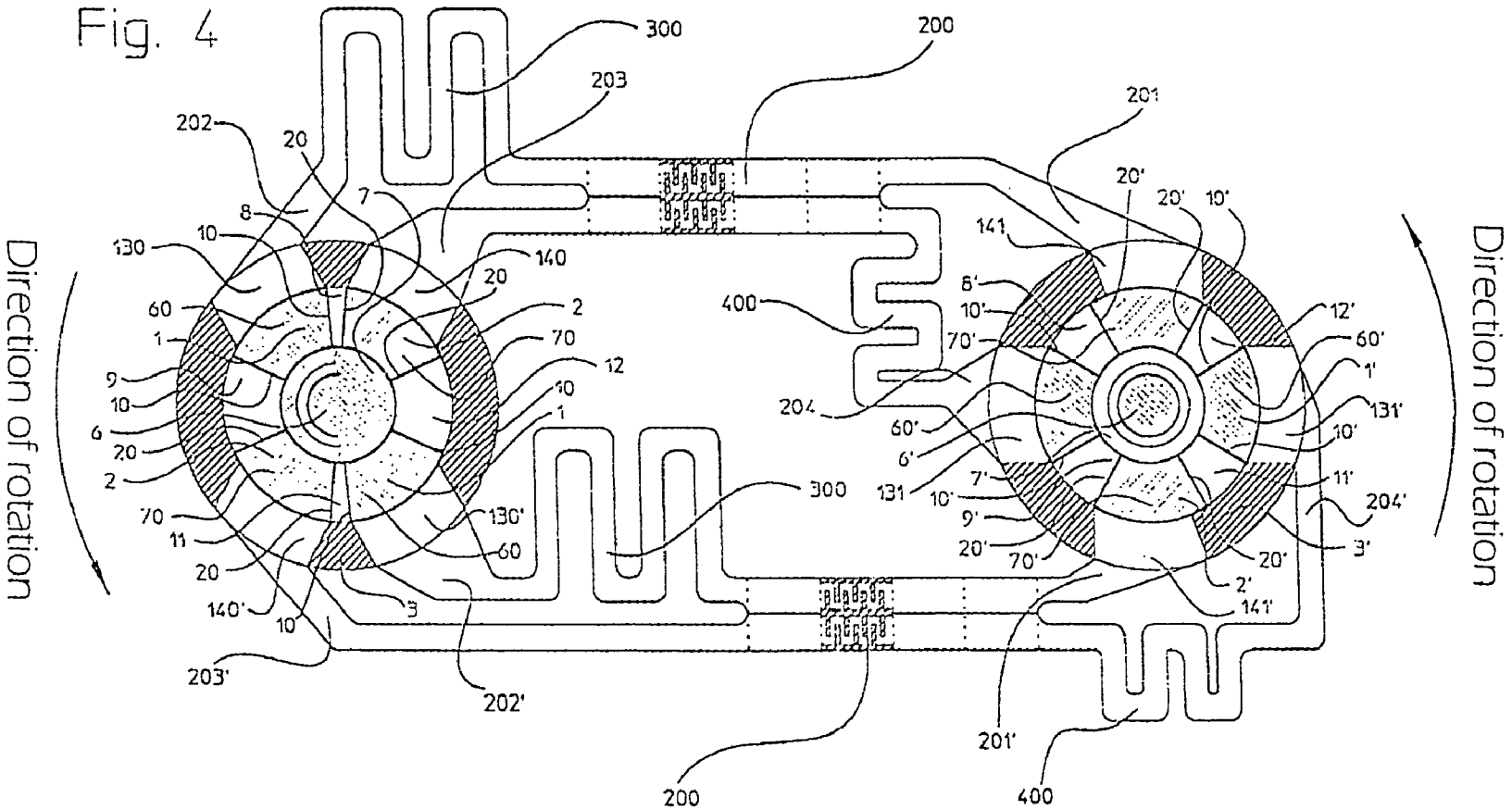
FIG. 4 is a cross sectional view of another improved embodiment of the rotary piston heat engine system of the invention in a first operating position.
Figure 4A:
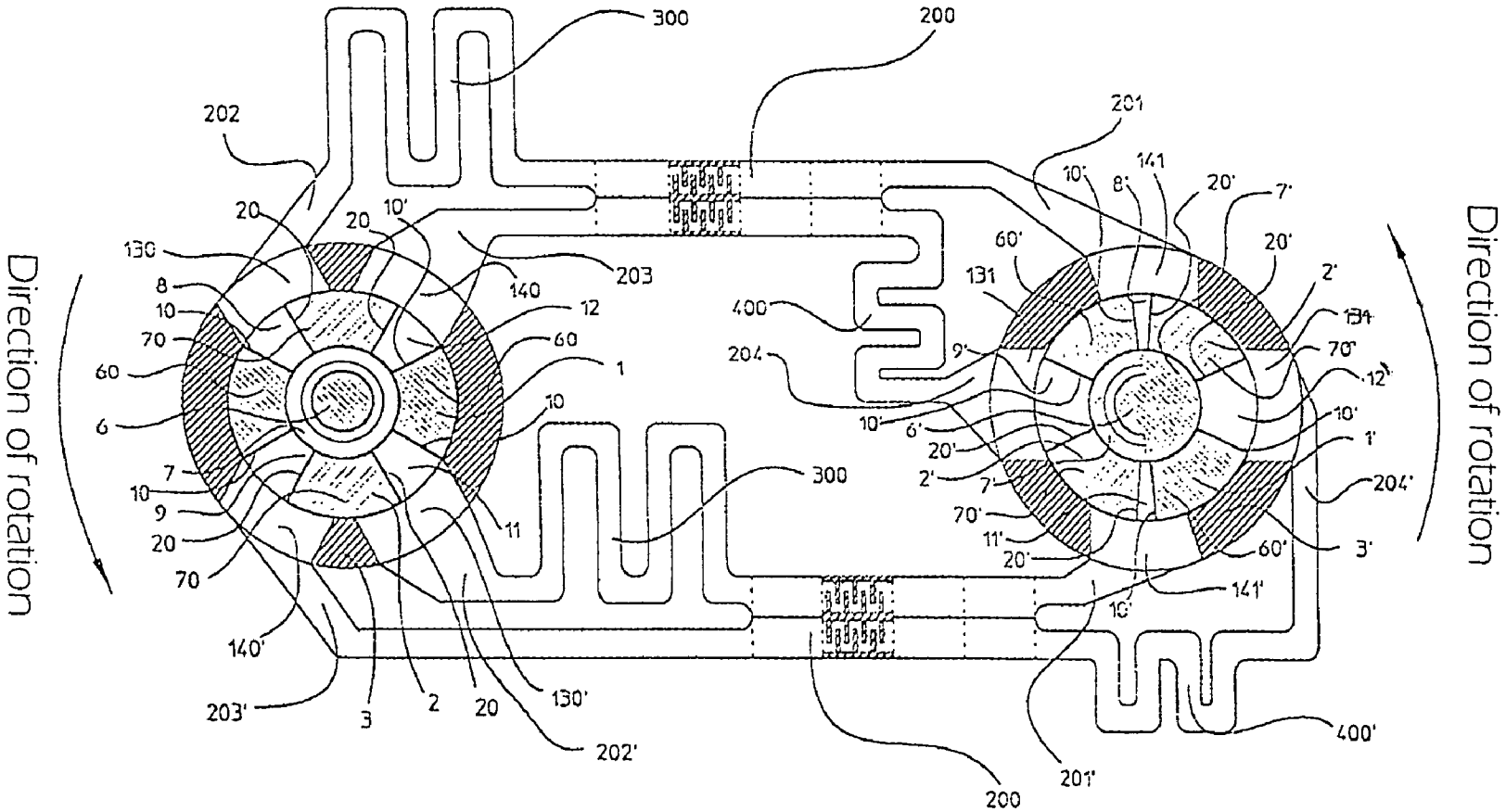
Figure 5:
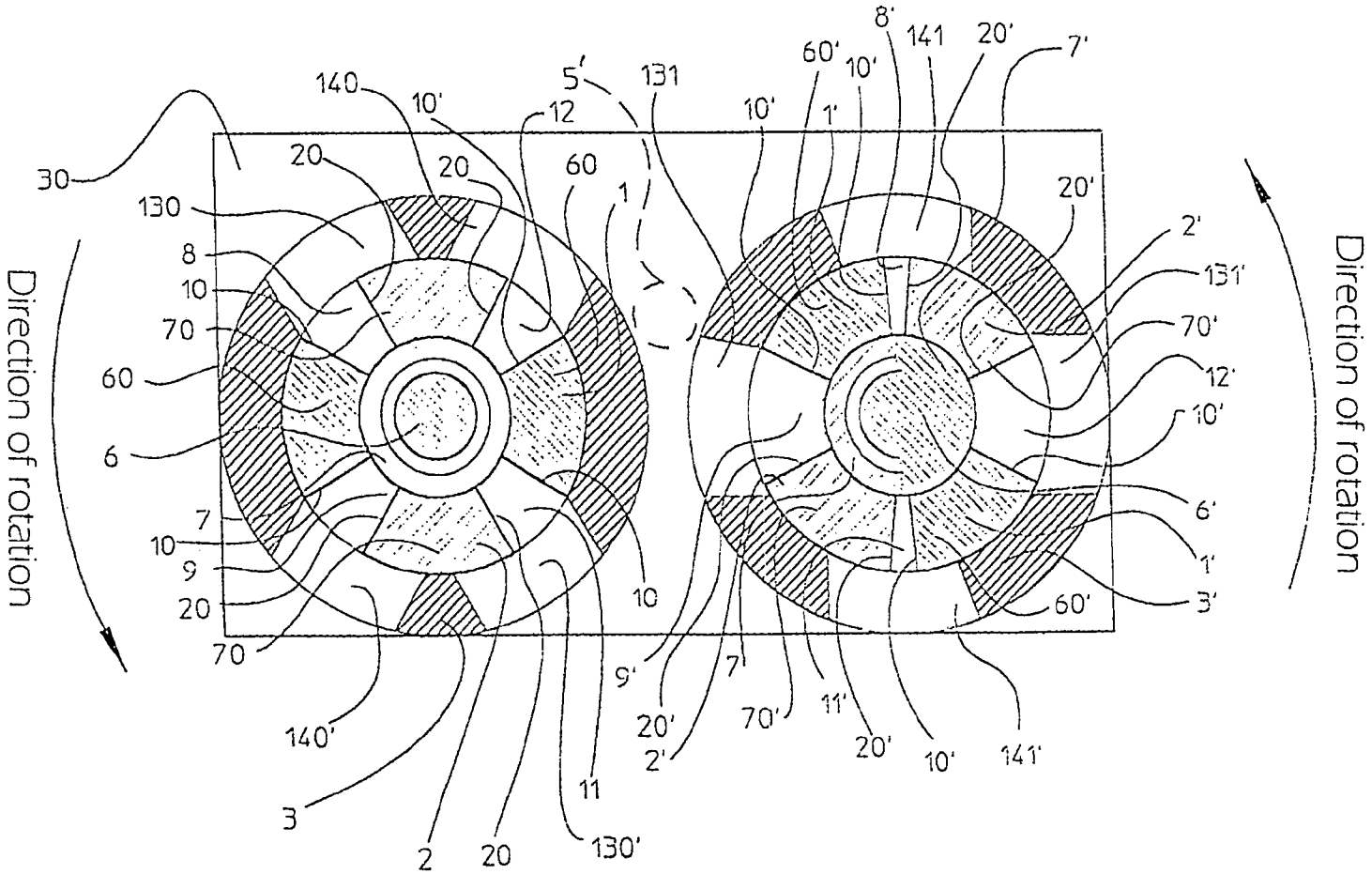

FIG. 4*a* is a cross sectional view of the rotary piston heat engine system of the invention shown in FIG. 4 in another operating position;

FIG. 5 shows the two cylinders of a rotary piston heat engine system of the invention according to FIG. 1 or FIG. 4, in a cross sectional view, wherein the relative position of the piston shafts and the torque-producing device can be discerned;

FIG. 6 shows a table with attachments 1 to 4, from which the changes in state of the working gas during a stroke cycle of the engine system can be discerned.

Figure 7:
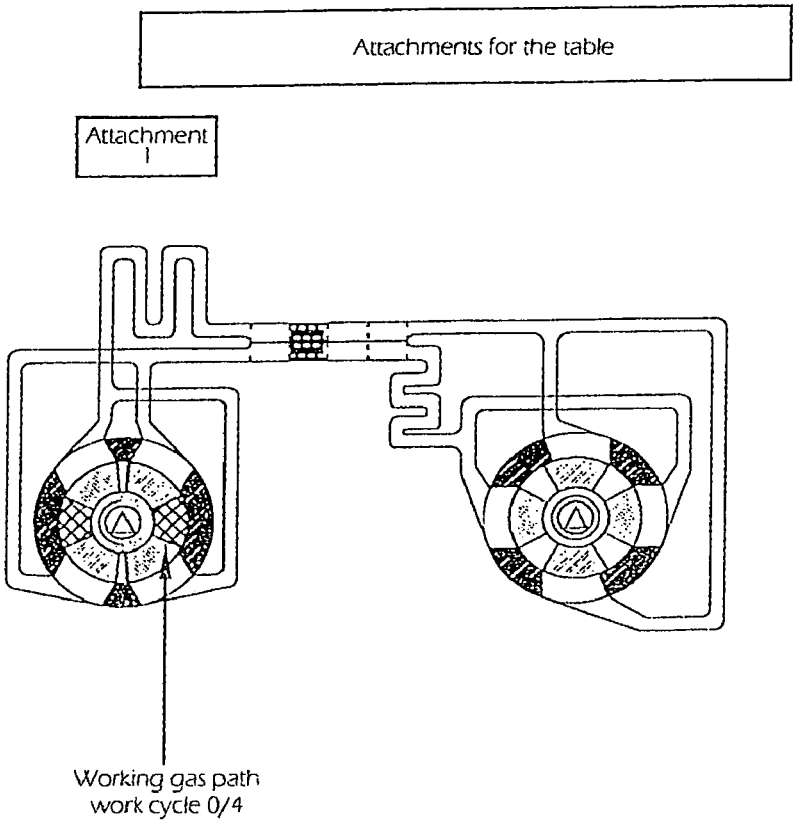
Figure 8:
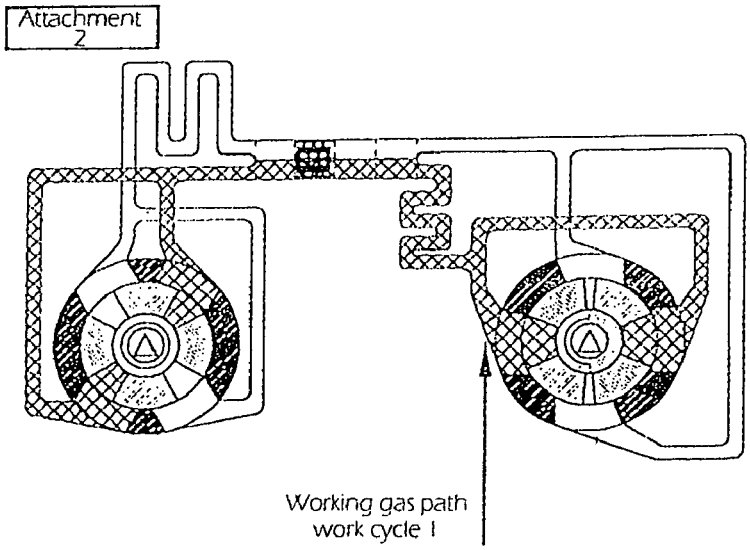
Figure 9:
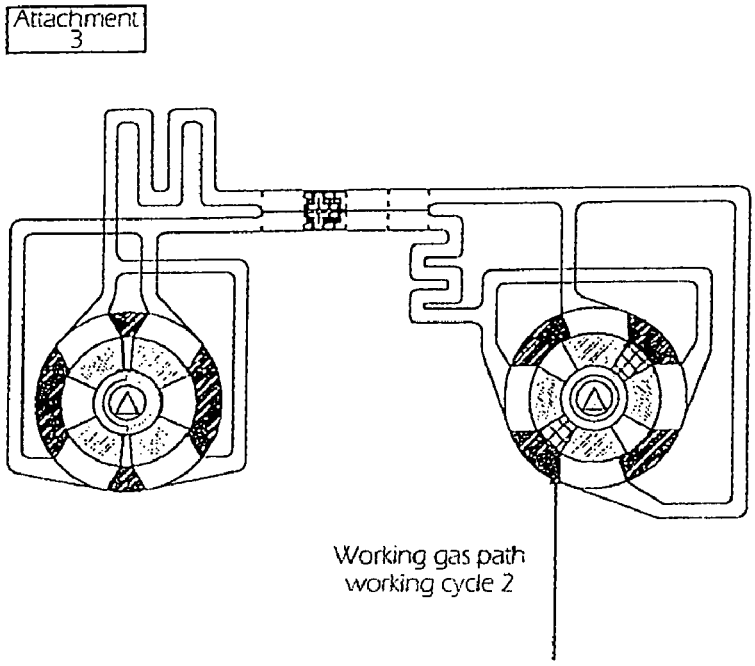
Figure 10:
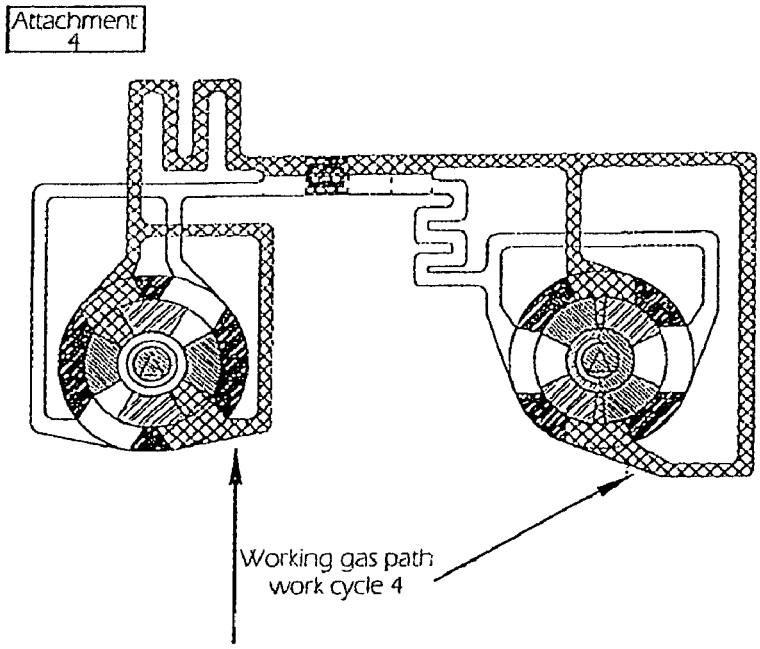

FIG. 7 shows a first attachment to the Table shown in FIG. 6 for clarification of the timing of a working gas;

FIG. 8 shows another attachment to the table shown in FIG. 6 for clarification of the timing of a working gas;

FIG. 9 shows another attachment to the table shown in FIG. 6 for clarification of the timing of a working gas;

FIG. 10 shows an attachment to the table shown in FIG. 6 for clarification of the timing of a working gas.

Figure 11:
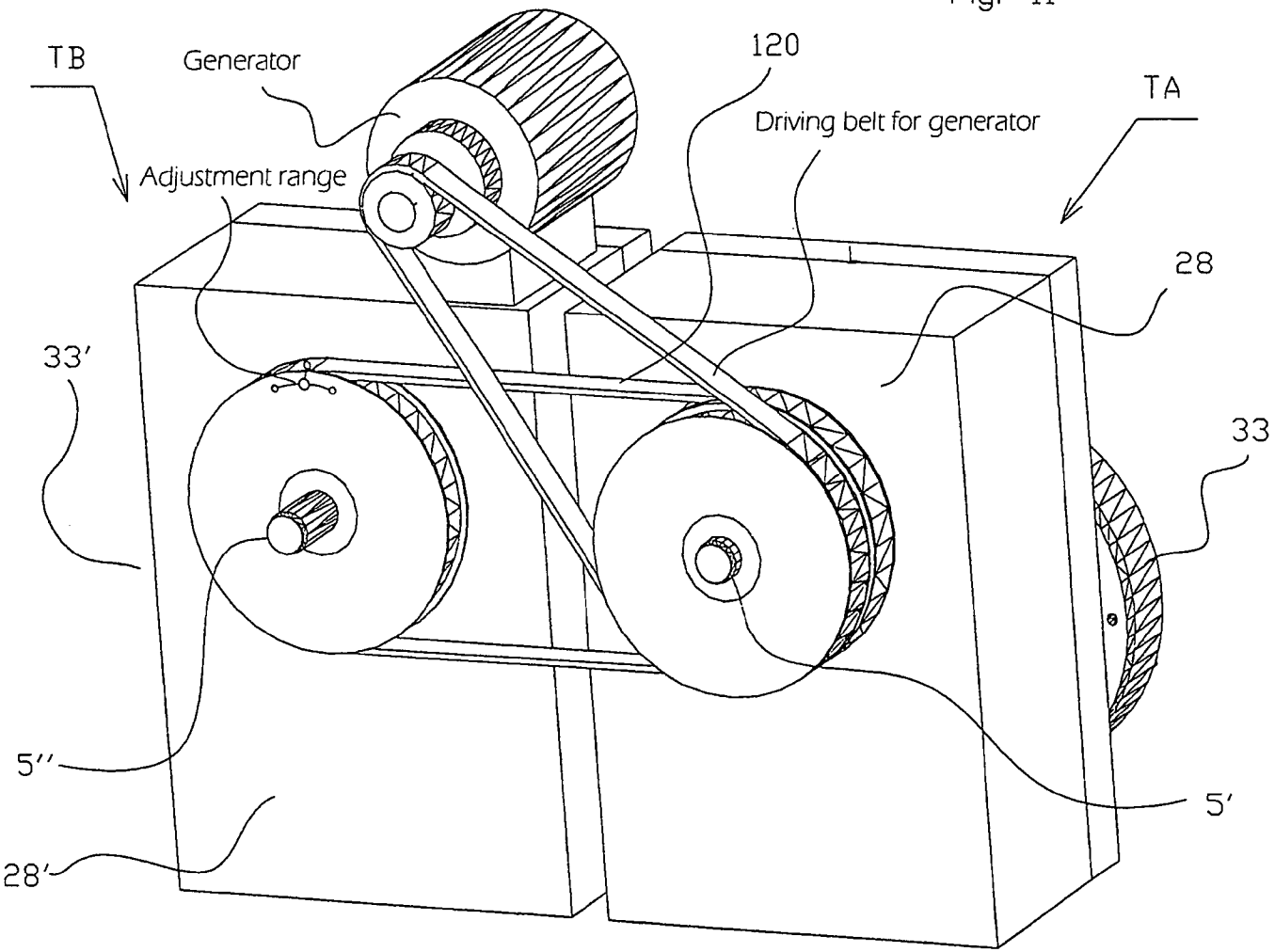

FIG. 11 is a rear view of a first preferred embodiment of a discrete adjustment system of the rotary piston heat engine system of the invention.

Figure 12:
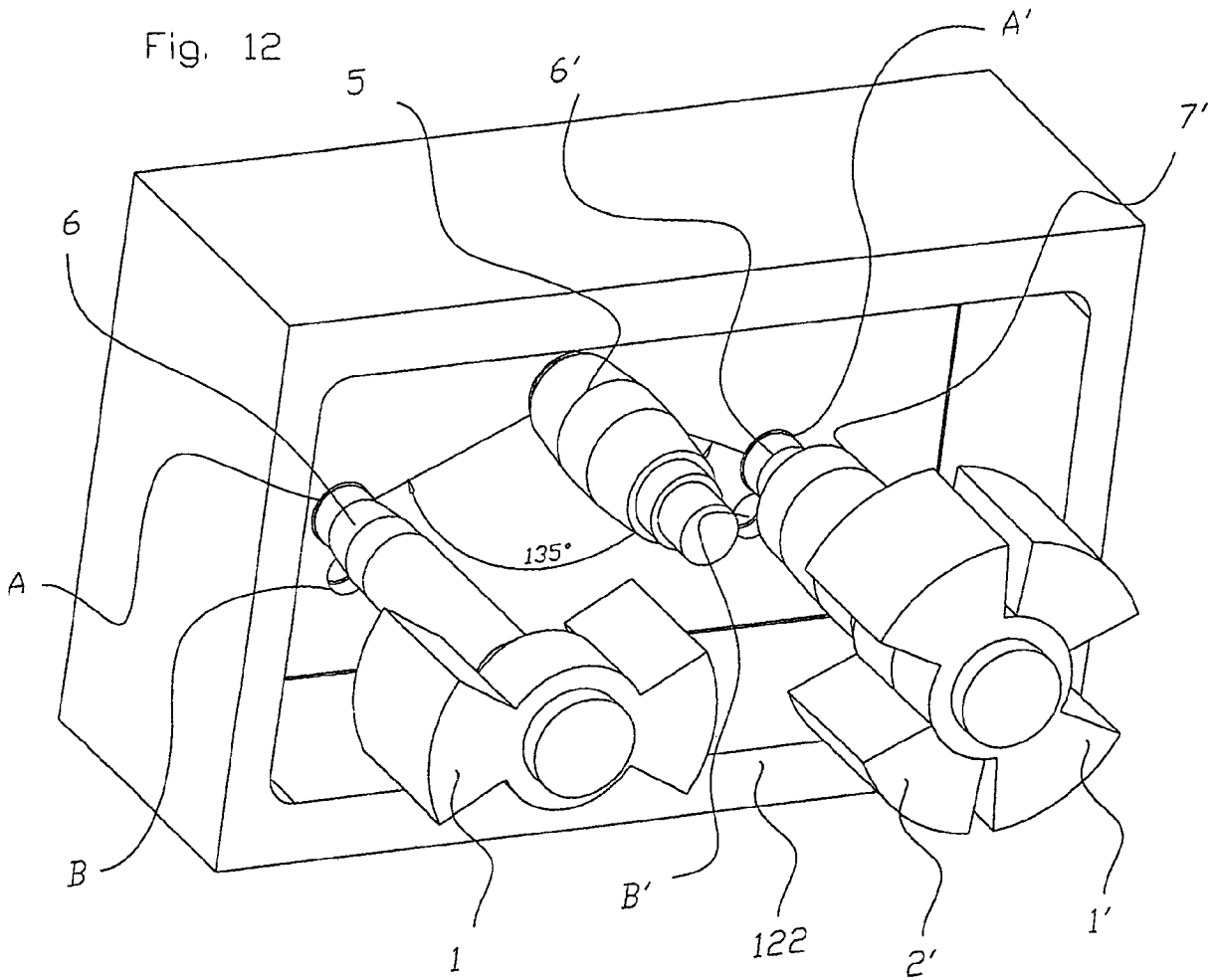
Figure 12A:
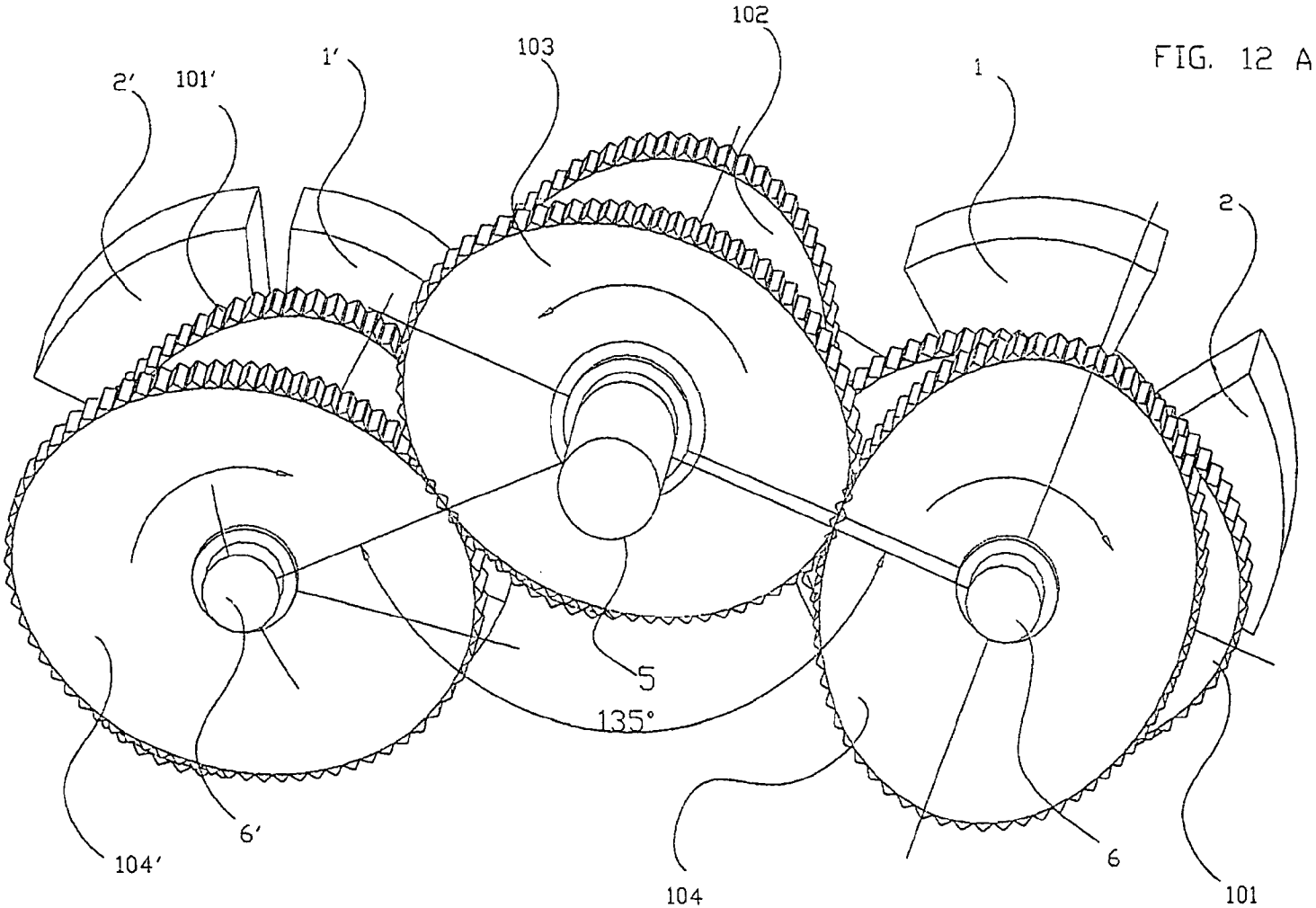

FIG. 12 is an oblique front view of a second preferred embodiment of a discrete adjustment system of the rotary piston heat engine system of the invention; note shaft 5;

FIG. 12A is a rear view of the shafts of the preferred embodiment of the discrete adjustment system of the rotary piston heat engine system of the invention shown in FIG. 12; note shaft 5.

Figure 13:
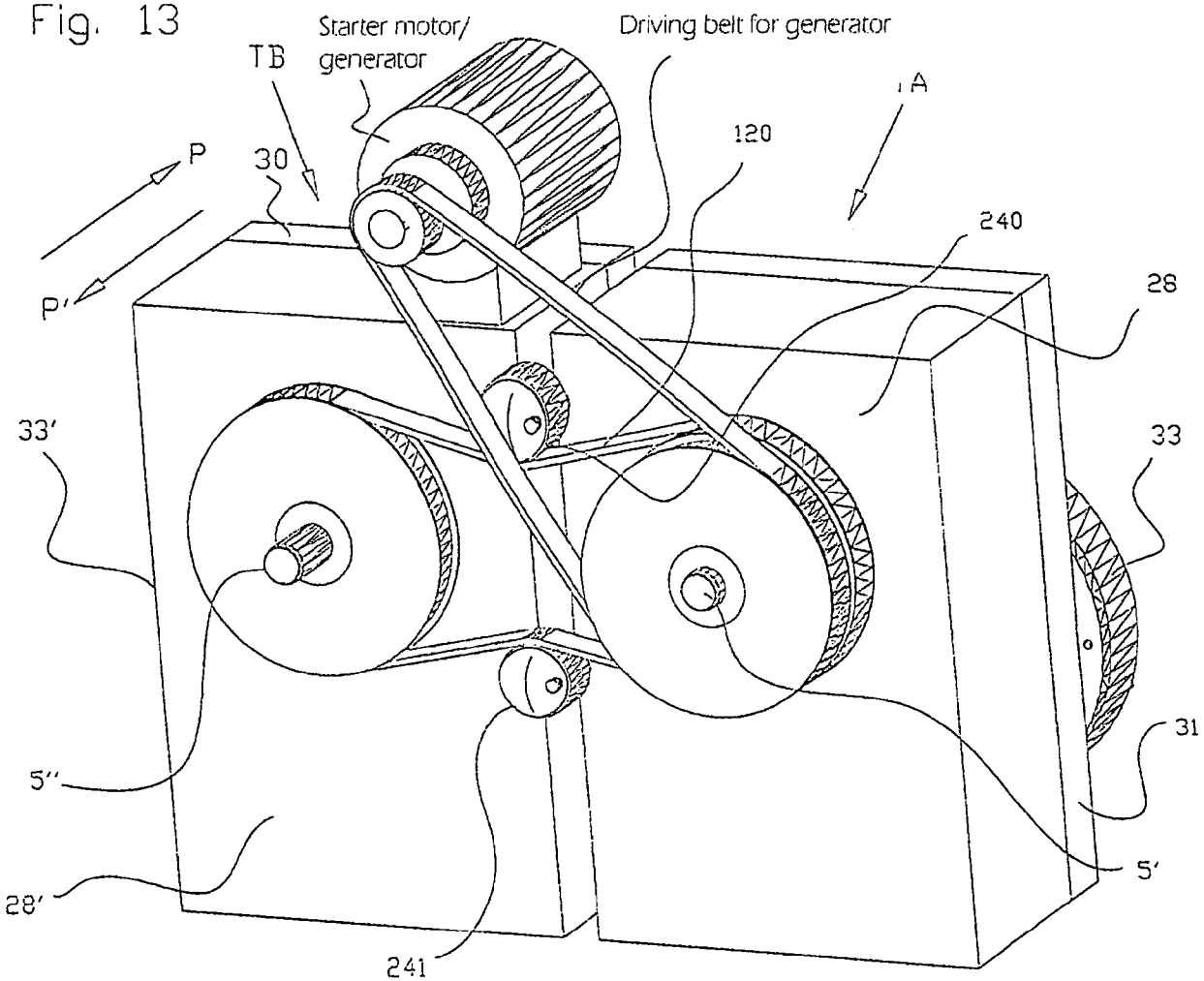

FIG. 13 is a rear view of a first preferred embodiment of a continuous adjustment system of the rotary piston heat engine system of the invention.

Figure 14:
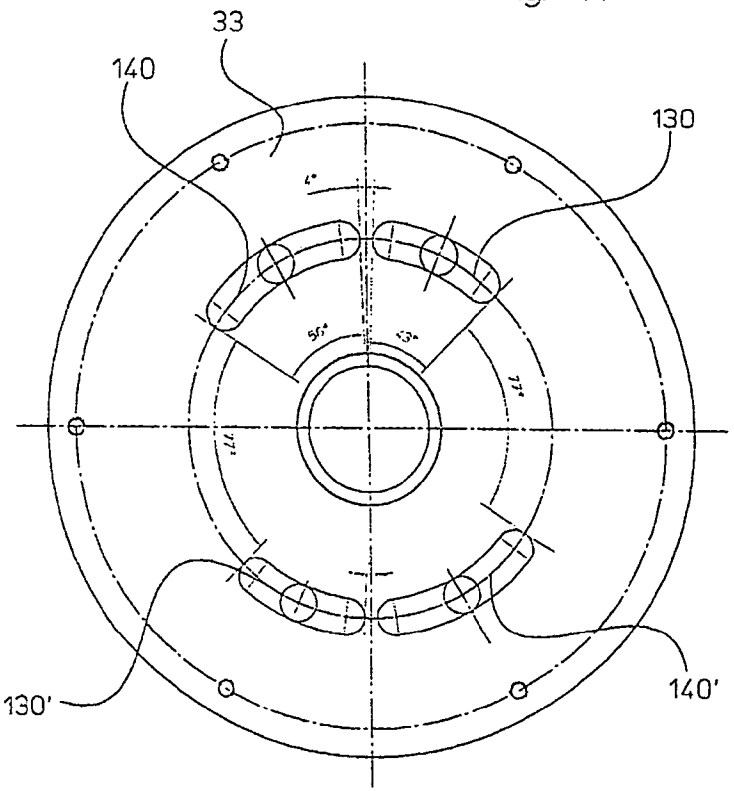
Figure 14A:
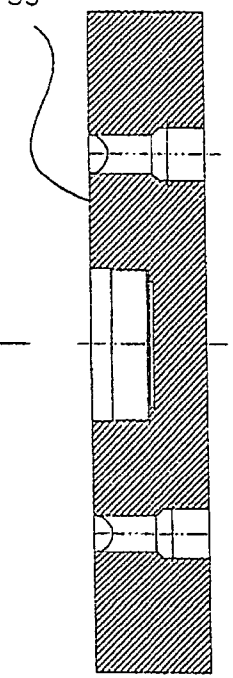

FIG. 14 is a view, drawn in the direction of the arrow P in FIG. 13, of the cylinder heads including inlet ports and outlet ports of a first cylinder of the rotary piston heat engine system of the invention;

FIG. 14A is a cross sectional view of the cylinder heads including inlet ports and outlet ports of the first cylinder of the rotary piston heat engine system of the invention.

Figure 14B:
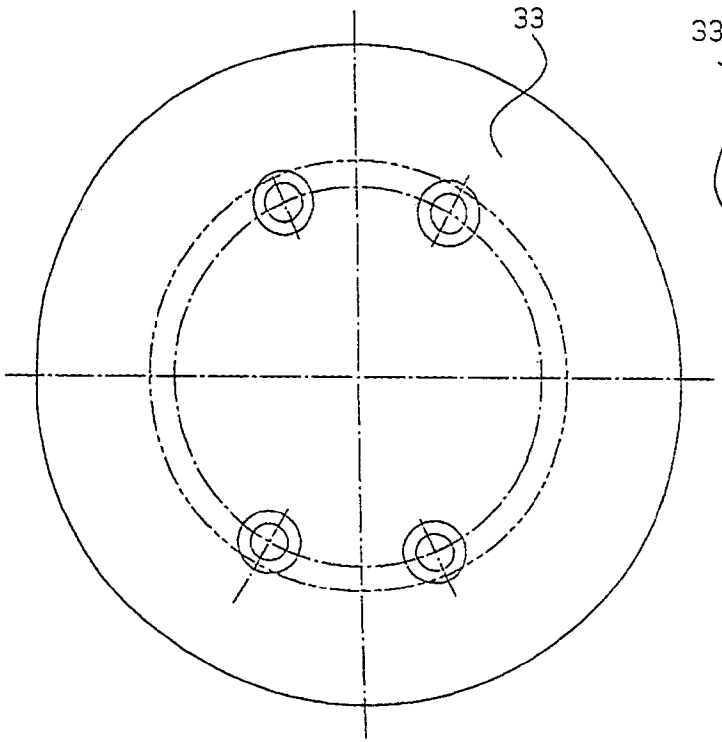
Figure 15:
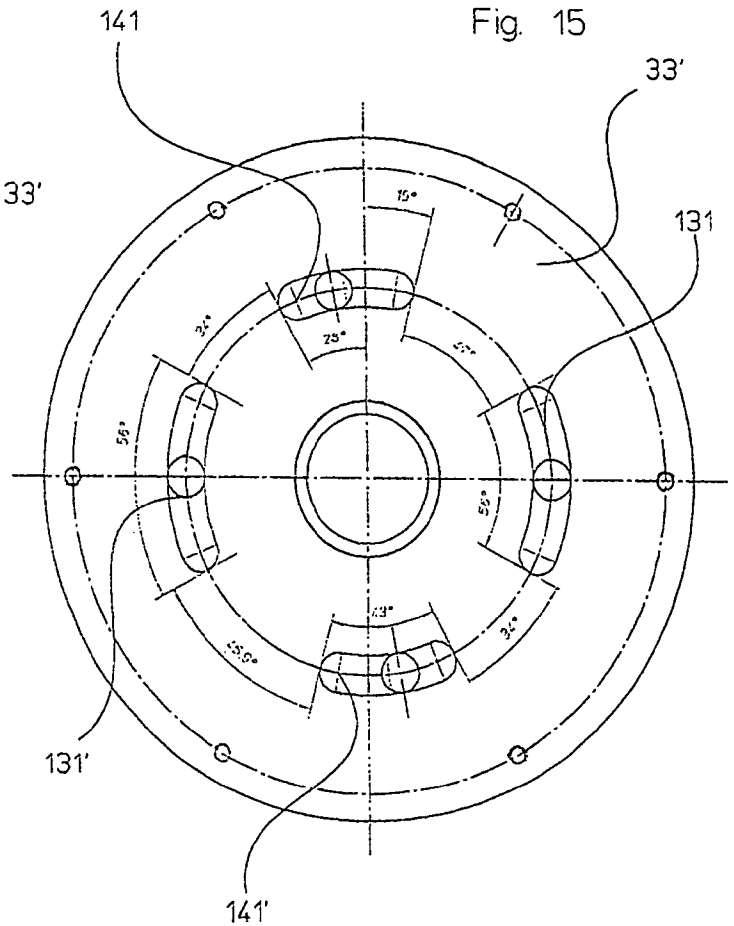
Figure 15A:
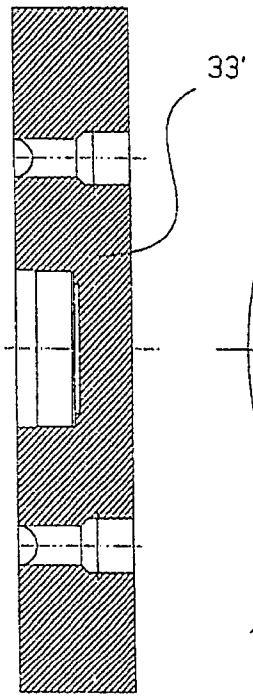
Figure 15B:
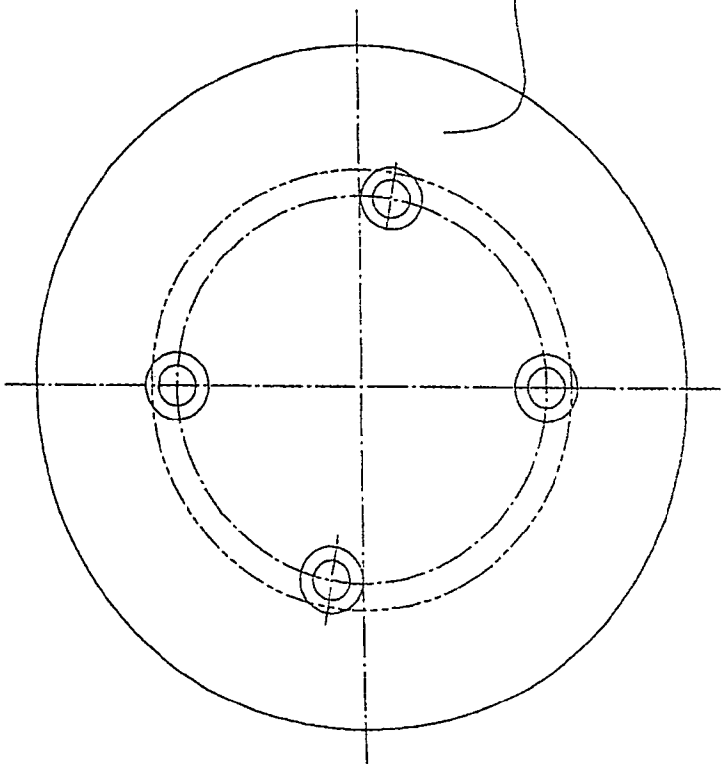
Figure 16:
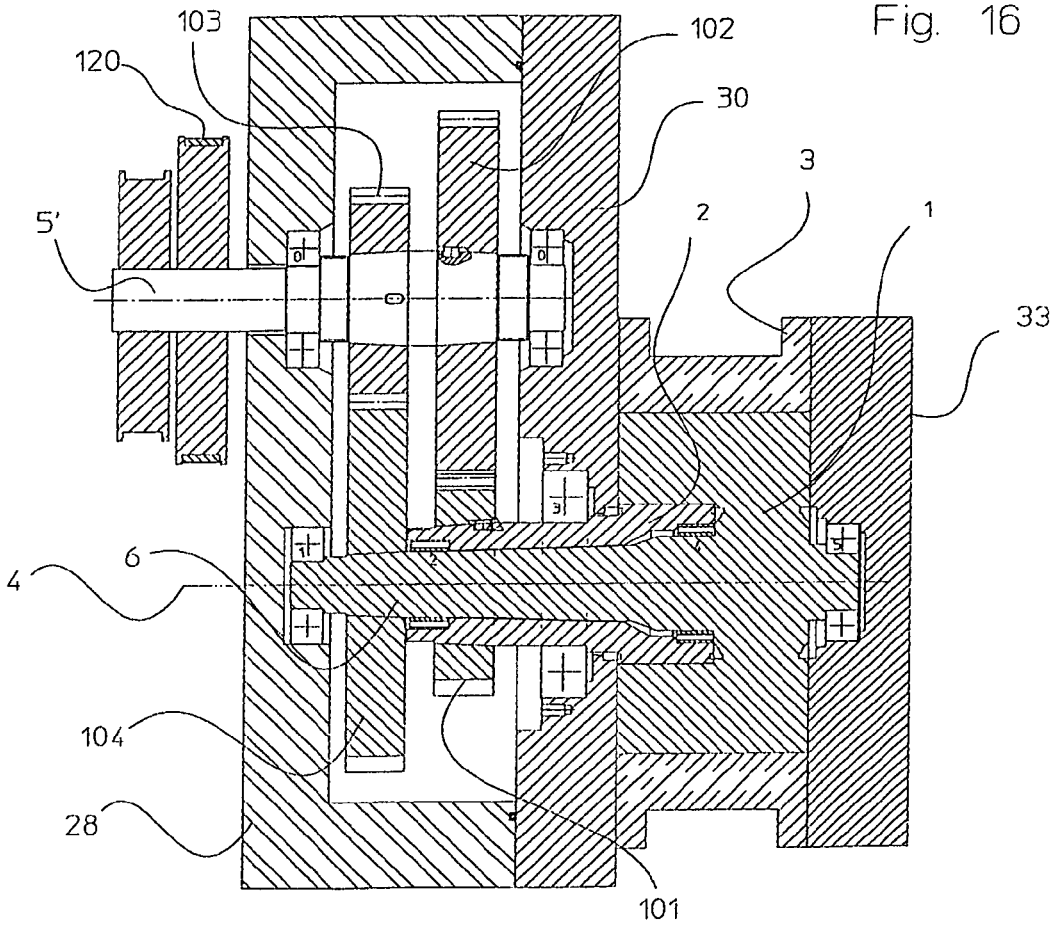
Figure 17:
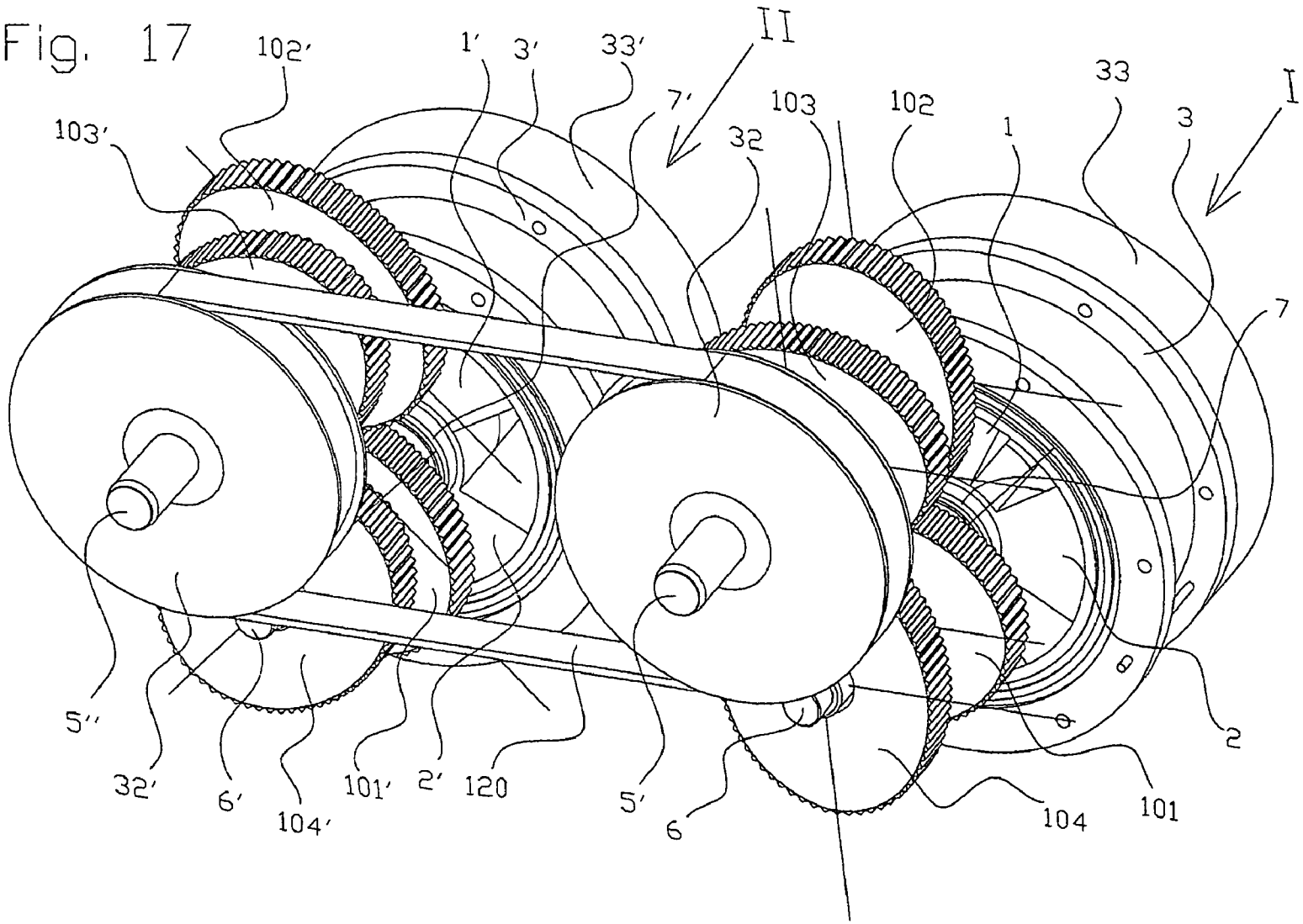
Figures 18, 18A, 18B:
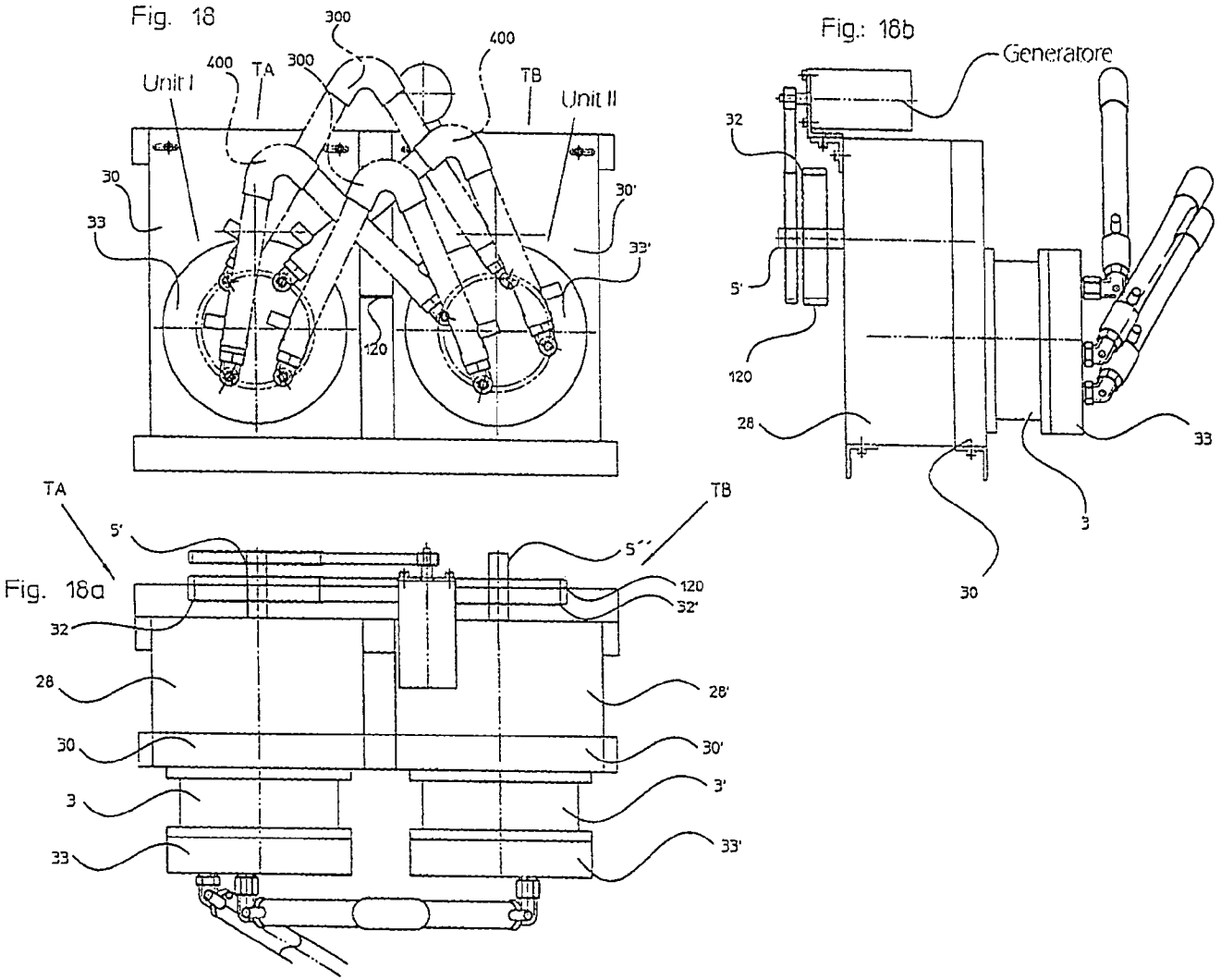
Figures 19, 20:
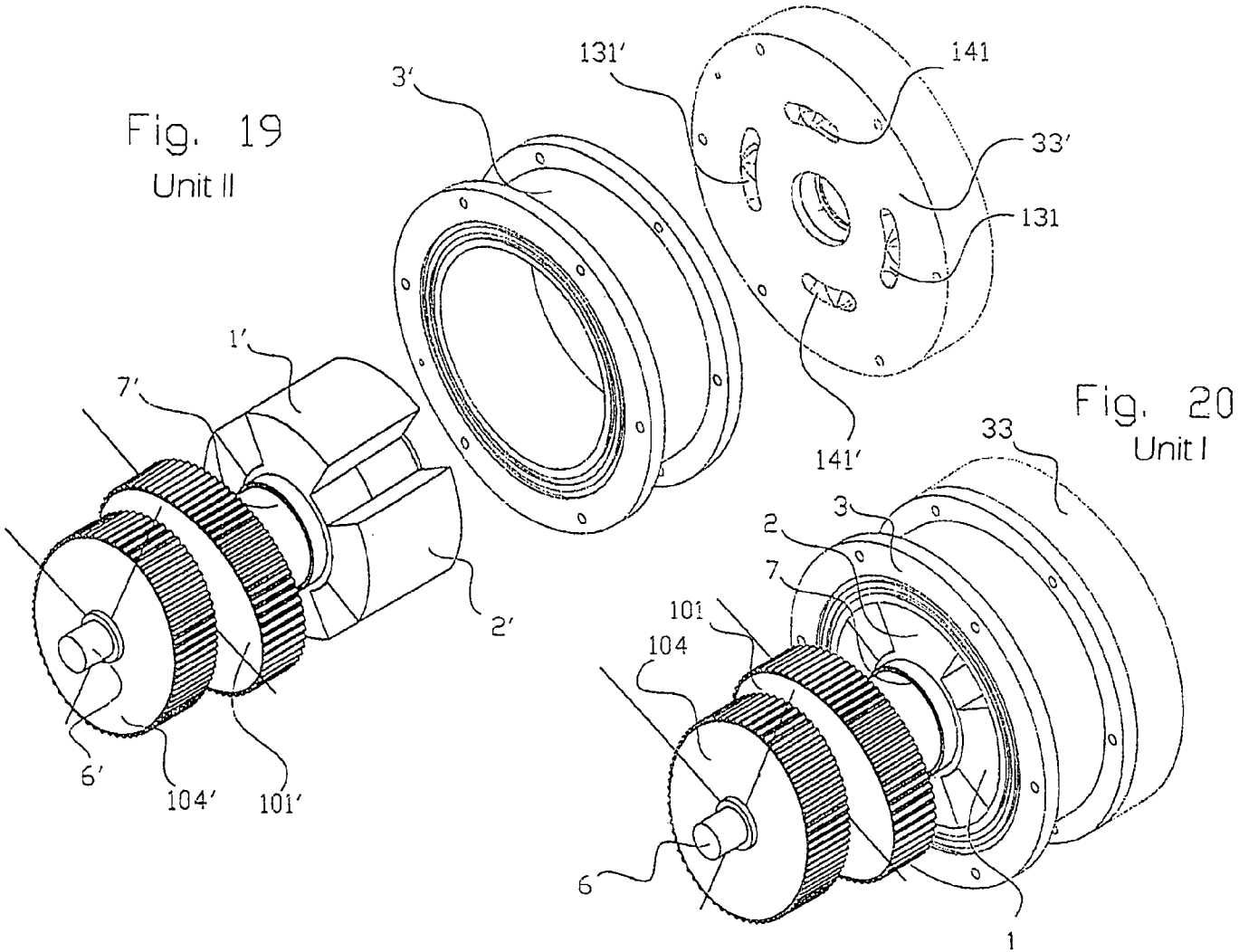

FIG. 14B is a view, drawn in the direction of the arrow P in FIG. 13, of the cylinder heads including inlet ports and outlet ports of the first cylinder of the rotary piston heat engine system of the invention;

FIG. 15 is a view, shown in the direction indicated by the arrow P in FIG. 13, of the cylinder heads including inlet ports and outlet ports of a second cylinder of the rotary piston heat engine system of the invention;

FIG. 15A is a cross sectional view of the cylinder heads including inlet ports and outlet ports of the second cylinder of the rotary piston heat engine system of the invention;

FIG. 15B is a view, shown in the direction of the arrow P in FIG. 13, of the cylinder heads including inlet ports and outlet ports of the second cylinder of the rotary piston heat engine system of the invention;

FIG. 16 is a cross sectional view of a temperature unit TA of the preferred embodiment shown in FIG. 11 of a discrete adjustment system of the rotary piston heat engine system of the invention;

FIG. 17 is an oblique rear view of the units I and II including the compensating device (belt 120 including belt wheels 32, 32') of the preferred embodiment shown in FIG. 11 of a discrete adjustment system of the rotary piston heat engine system of the invention;

FIG. 18 is a front view of the units I and II, with their respective temperature units TA and TB thermally coupled to each other, of the preferred embodiment shown in FIG. 11 of a discrete adjustment system of the rotary piston heat engine system of the invention;

FIG. 18*a* is a top view of the units I and II, with their respective temperature units TA and TB thermally coupled to each other, of the preferred embodiment shown in FIG. 11 of a discrete adjustment system of the rotary piston heat engine system of the invention;

FIG. 18*b* is a side view of the units I and II, with their respective temperature units TA and TB thermally coupled to each other, of the preferred embodiment shown in FIG. 11 of a discrete adjustment system of the rotary piston heat engine system of the invention;

FIG. 19 is an exploded view of a unit II of the temperature unit TB of a discrete adjustment system of the rotary piston heat engine system of the invention;

FIG. 20 is an oblique top view of a unit I of a temperature unit TA of a discrete adjustment system of the rotary piston heat engine-system of the invention.

In the rotary piston heat engine system 100 of the invention shown in FIGS. 1 to 10, two pistons 1, 2 are rotatably mounted in a cylinder 3, wherein the axes of symmetry 14, 15 of the piston 1, the piston 2 and the cylinder 3 are collinearly aligned. The axle 6 of one of the pistons 1 is formed as a solid rod 6, and the axle 7 of the other of the pistons 2 is formed as a hollow rod 7, whose internal diameter is dimensioned such that the solid rod 6 is mounted for rotation within the hollow rod 7. The pistons 1, 2 each comprise boundary surfaces 10, 20, adjacent parts of the opposing boundary surfaces 10, 20 being spaced at equal intervals. A plurality of effective cylinder displacements 8, 9, 11, 12 is formed between the respective boundary surfaces 10, 20, the cylinder displacements being delimited on the outside by the cylinder 3 and at the ends by a cylinder head 33 and a cover plate 30.

Furthermore, the two pistons 1', 2' are mounted for rotation in a cylinder 3' in the rotary piston heat engine system 100 of the invention shown in FIGS. 1 to 6, wherein the axes of symmetry 14', 15' of the piston 1', the piston 2' and the cylinder 3' are collinearly aligned. The axle 6' of one of the pistons 1' is embodied as a solid rod 6', and the axle 7' of the other of the pistons 2' is embodied as a hollow rod 7' whose internal diameter is dimensioned such that the solid rod 6' is mounted for rotation within the hollow rod 7'. The pistons 1', 2' comprise in each case boundary surfaces 10', 20' wherein equal spacings are provided in each case between adjacent parts of the opposing boundary surfaces 10', 20'. A plurality of effective cylinder displacements 8', 9', 11', 12' is formed between the respective boundary surfaces 10', 20', the cylinder displacements being delimited on the outside by the cylinder 3' and at their ends by the cylinder head 33' and the cover plate 30'.

The two cylinders of the engine system of the invention have differently dimensioned and differently aligned cylinder wall sections between the respective inlet and outlet ports. In a first cylinder of the engine of the invention, a cylinder wall encompassing only a few angular °s is provided between a first inlet port of a pair of inlet ports and a first adjacent outlet port of a pair of outlet ports, and a cylinder wall encompassing about 60 angular °s is provided between the same inlet port of the pair of inlet ports and another outlet port of the pair of outlet ports.

In a second cylinder of the engine system of the invention, a cylinder wall encompassing only about 30 angular °s is provided between a first inlet port of a pair of inlet ports and a first adjacent outlet port of a pair of outlet ports, and a cylinder wall likewise encompassing about 30 angular °s is provided between the same inlet port of the pair of inlet ports and another outlet port of the pair of outlet ports.

The asymmetry between the inlet and outlet ports of the first cylinder and the second cylinder effect a timely transport of the working gas from one cylinder to the other so that the engine is able to deliver a work output.

Figure 2:
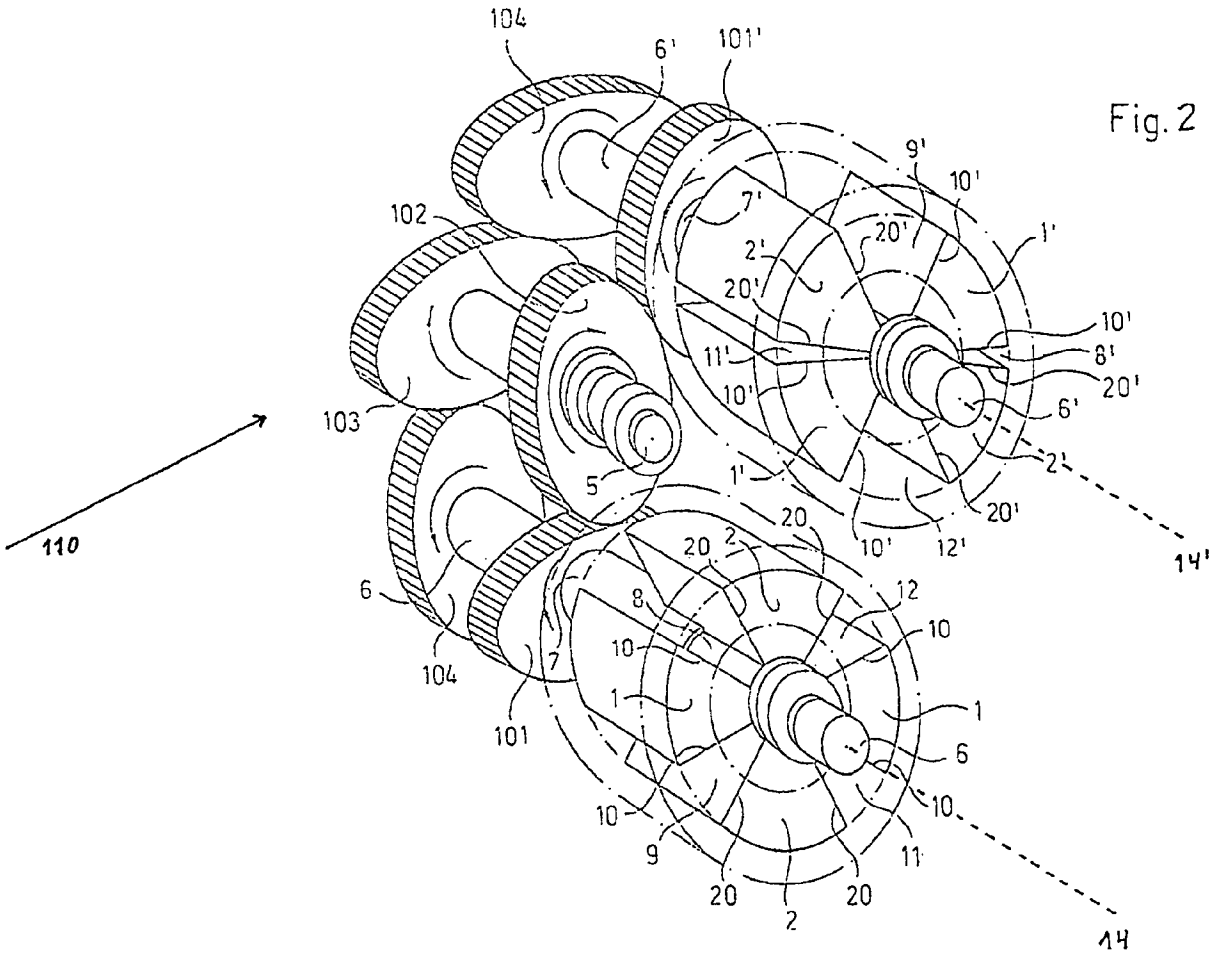

A mechanism 110 shown in FIG. 2 superimposes a circular motion on the angular motion of the pistons 1, 2 and of the pistons 1', 2' in the rotary piston heat engine system 100 of the invention.

The mechanism 110 comprises six oval gear wheels 101, 102, 103, 104, 101' and 104' whose principal axes 111, 112, 113, 114, 111' and 114' are vertically superposed in pairs. In the mechanism 110, the axle 7 of the other piston 2 is connected to a first oval gear wheel 101, and the axle 6 of one of the pistons 1 is connected to a second oval gear wheel 104, which oval gear wheels 101, 104 are collinearly aligned and the principal axes 111, 114 of the oval gear wheels 101, 104 are vertically superposed. The first oval gear wheel 101 and the second oval gear wheel 104 are connected to each other via a third oval gear wheel 102 and a fourth oval gear wheel 103, the gear wheels 102 and 103 being collinearly disposed on a shaft 5, while the respective principal axes 112, 113 of the gear wheels 102, 103 are vertically superposed.

Furthermore, in the mechanism 110, the axle 7' of the other piston 2' is connected to a first oval gear wheel 101', and the axle 6 of one of the pistons 1 is connected to a second oval gear wheel 104', which oval gear wheels 101', 104' are collinearly aligned and the principal axes 111', 114' of the oval gear wheels 101', 104' are vertically superposed. The first oval gear wheel 101 and the second oval gear wheel 104 are connected to each other via a third oval gear wheel 102 and a fourth oval gear wheel 103, which gear wheels 102 and 103 are collinearly aligned on a shaft 5, while the respective principal axes 112, 113 of the gear wheels 102, 103 are vertically superposed.

The gear wheels 102 and 103 and the shafts 5', 5" of the two units (cylinders 3 and 3') are operated in such a configuration. The aforementioned shaft 5 is shown in two separate temperature units, and is therefore designated as shaft 5' in a first temperature unit and as shaft 5" in a second temperature unit.

Figure 3:
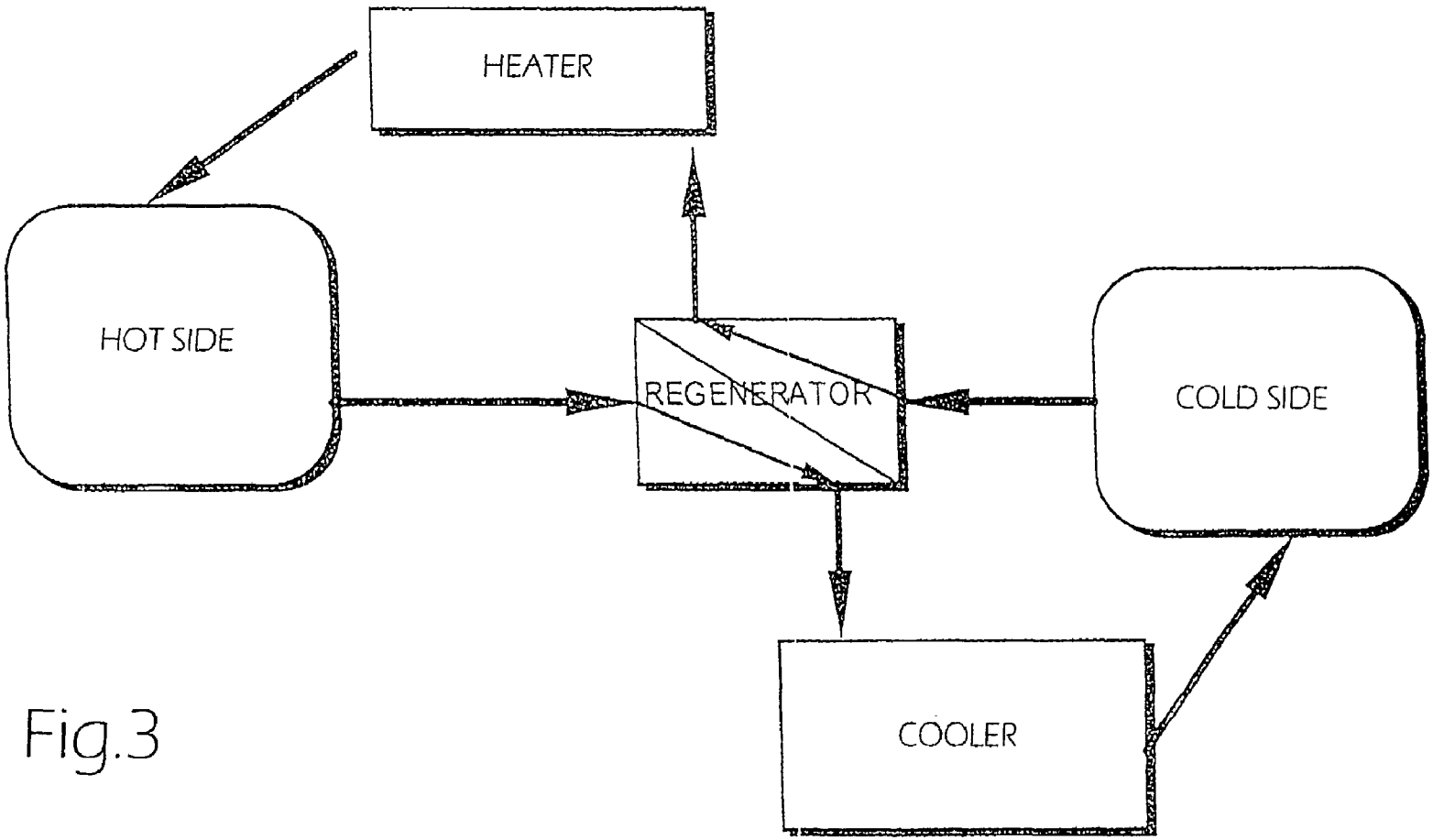
FIG. 3 is a functional block diagram of the rotary piston heat engine device shown in FIG. 1.

Such an arrangement applies, for example, to a construction such as is shown in FIGS. 3, 12 and 12*a*.

Another type of construction is shown in FIGS. 11, 13 and 16 to 18*b*. Herein, eight non-circular gear wheels (101, 102, 103, 104, 101', 102', 103', 104') embodied as oval gear wheels are linked to each other via the shafts 5' and 5" as well as a connecting member (clutch, toothed belts, chain, or the like).

The oval gear wheels 101 to 104 as well as 101' to 104' have a 1.7:1 ratio of the length of their longitudinal axes to that of their transverse axes.

During operation of the rotary piston heat engine system 100 of the invention, expansion of a heated working gas, for example in the cylinder displacement 9 of the cylinder 3, causes the pistons 1, 2 to move away from each other. The oval gear wheel 101 connected to the axle 7 of the piston 2 moves in the direction of the arrow shown on its surface in FIG. 2. In the starting position shown in FIG. 2, rotation of the gear wheel 104 through a small angular deflection effects a relatively large angular deflection of the gear wheel 103 disposed on the shaft 5. The gear wheel 102 likewise disposed on the shaft 5 transfers this motion to the gear wheel 101 thus producing another increase of the angular deflection of the axle 7 of the piston 2.

The variable, fluctuating local force transfer of the gear wheels 101 and 104 respectively superimposes a circular motion on the angular motion of the pistons 1, 2. The working shaft 5 rotates at the mean rotary speed of the two pistons 1 and 2. The rotational energy of the engine is outputtable at a constant angular velocity on the extension of the working shaft 5 or 5' or 5". The rotational energy of the engine showing a four-fold change in angular velocity per revolution is outputtable at the extension of the shaft 6, as is desirable, for example, for the operation of compressors.

The same applies to the unit comprising the cylinder 3'.

Figure 1A:
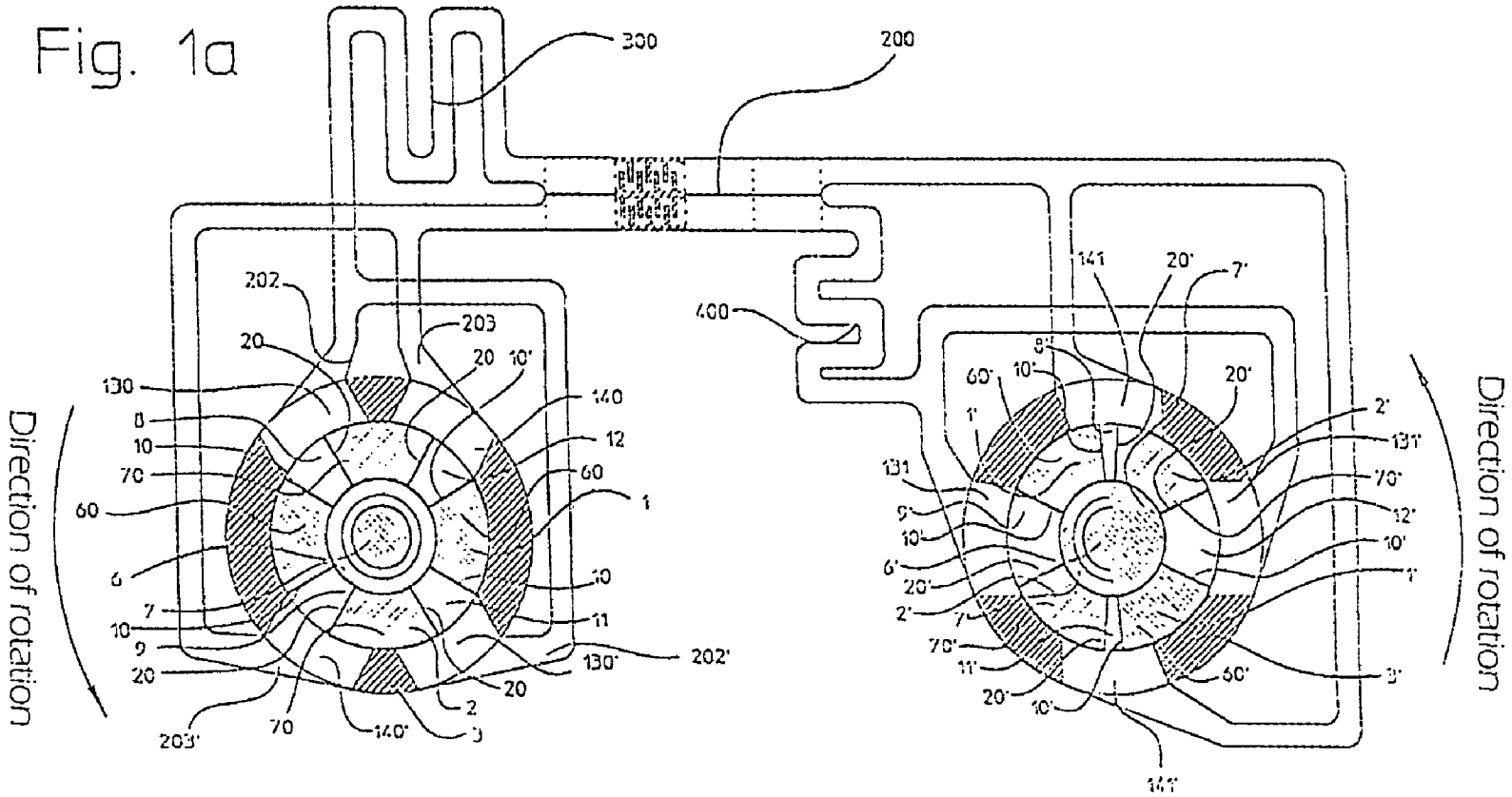

FIGS. 1 and 1*a* show an embodiment of the engine system of the invention in which two cylinders 3, 3' with their respective piston pairs 1, 2 and 1', 2' are coupled to each other via a corresponding pipe system 201, 201', 202, 202', 203, 203' and 204, 204', respectively, via a heater 300, a cooler 400 and a regenerator or heat exchanger 200.

At the beginning of a work cycle, heated working gas flows from the heater 300 via the pipe system 202, 202' into the inlet ports 130, 130' of the cylinder 3. The hot working gas then flows into the space between the pistons 1, 2, whereby the pistons are forced apart. This compresses the space between the piston surfaces of the pistons 1, 2, which are located in the proximity of the outlet ports 140, 140 of the cylinder 3, causing the working gas therein to escape via the pipe system 203, 203'. Via the pipe system 203, 203', the working gas expelled from the cylinder 3 passes into the pipe system 204, 204' of the cylinder 3 via a heat exchanger 200, to which it dissipates its heat, and via a cooler 400, on which it is further cooled.

From the pipe system 204, 204', the now cooled working gas enters, via the inlet ports 131, 131' of the cylinder 3, the spaces between the pistons 1 and 2 located in the proximity of the inlet ports, and the spaces between the pistons are expanded, and the spaces flanking each of the opposing piston surfaces of the pistons 1, 2 are compressed, causing the working gas located therein to be forced, via the outlet ports 141, 141', out of the cylinder 3 into the pipe system 201, 201. Via the pipe system 201, 201, the working gas flows further through the regenerator or the heat exchanger 200, where it acquires heat from the working gas that is flowing through the heat exchanger 200 via the pipe system 203, 203'.

After exiting the heat exchanger 200, the now heated working gas coming from the pipe system 201, 201' flows on through a heater 300, in which it is further heated. From there it flows into the pipe system 202, 202', whence the cycle is repeated.

In the Stirling engine of the invention shown in FIGS. 4 and 4*a*, two cylinders 3, 3' are coupled together via a corresponding pipe system via two heaters 300 and 300', two regenerators or heat exchangers 200, 200' and two coolers 400 and 400', respectively.

At the beginning of a rotation cycle of this engine, heated working gas flows from the respective heaters 300, 300' via the respective pipes 202, 202' into the inlet port 130, 130' of the cylinder 3. Via the inlet ports 130, 130', the hot working gas enters the spaces between the pistons 1, 2 located under the ports, forcing the pistons apart, and thereby compressing the spaces formed in each case between the pistons 1, 2 by the opposing piston surfaces 10, 20, and forcing the working gas located therein into the respective pipes 203, 203' via the outlet ports 140, 140', respectively.

The working gas forced into the pipe 203 enters the pipe 204 via the regenerator 200 and the cooler 400, respectively, the pipe 204 opening into the inlet port 131 of the cylinder 3, and the working gas forced into the pipe 203' enters the pipe 204' via the regenerator 200' and the cooler 400', the pipe 204' opening into the inlet port 131'. The working gas entering the inlet port 131' of the cylinder 3' has consequently dissipated part of its heat to the regenerator 200 and it is then further cooled by the cooler 400, so that it is present at the inlet port 131 with a substantially reduced temperature compared with the pipe 203.

The working gas present at the inlet port 131' has dissipated a large portion of its heat to the regenerator 200' and is then further cooled by the cooler 400', so that it is present at the inlet port 131' of the cylinder 3' in a substantially cooled state compared with the pipe 203'. Via the inlet ports 131, 131' of the cylinder 3', cold working gas consequently enters the spaces between the pistons 1' and 2' located under the inlet ports, wherein the spaces between the pistons are expanded, and the spaces located under the outlet ports 141, 141' of the cylinder 3' and formed in each case by the opposing piston surfaces 10', 20' of the pistons 1', 2' are compressed. The compression of the spaces between the pistons forces the working gases therein into the pipe 201 or into the pipe 201' via the outlet ports 141, 141', respectively.

The working gas in the pipe 201 is first preheated by the regenerator 200 and then heated by the heater 300, whence it enters the pipe 202. The working gas in the pipe 201' is first preheated by the regenerator 200' and then heated by the heater 300', whence it enters the pipe 202'. The cycle described above is then repeated.

The sequence of operations of the engine systems of the invention shown in FIG. 1 and in FIG. 1*a* and FIG. 4 is identical. In principle, the working gas in the pipe system and the cylinders passes through four changes of state, which are determined by corresponding duty cycles of the pistons of the cylinders 3, 3' respectively.

In a first work cycle of the engine of the invention, working gas is compressed in the respective spaces between the pistons 1, 2, 1', 2' of the cylinders 3, 3' by a mutual advance of the respective pistons In a second work cycle of the engine of the invention, the working gas thus heated, which is forced via the outlet port 141 of the cylinder 3 into the pipe 201 and via the outlet port 141' of the cylinder 3' into the pipe 201', respectively, is further heated by the regenerators 200 and 200' and the heaters 300 and 300', respectively, whereby the pressure prevailing in the working gas is further increased. The overall pressure of the working gas in the entire pipe system is thus at its maximum in the pipe 202 rearward of the heater 300 or in the pipe 202' rearward of the heater 300'.

Highly pressurized working gas thus enters the cylinder 3 via the inlet ports 130, 130' and enters corresponding spaces between the pistons 1, 2 and forces the pistons apart under high pressure. This corresponds to a third operating cycle of the engine of the invention. In this operating cycle of the engine of the invention, the thermal energy of the working gas is transformed into rotational energy for the pistons by forcing apart the spaces between the pistons 1, 2 of the cylinder 3. In doing so, the working gas cools in a third change of state.

In a fourth operating cycle of the engine of the invention, the working gas thus decompressed is forced out of the cylinder 3 via the outlet ports 140, 140', while the corresponding spaces between the pistons 1, 2 are compressed due to an expansion of the spaces between the pistons that follow in the direction of rotation of the engine. The working gas then undergoes a fourth change of state, wherein it is further cooled by the regenerators 200 and 200' and the coolers 400 and 400', so that it is present in the pipes 204 and 204', respectively, in a highly cooled state.

The working gas is further compressed at the time of entry into the inlet ports 204' and 204 and after entry into the inlet ports 204 and 204', respectively.

The state of the working gas, in terms of its pressure and temperature, is concisely summarized in Table 1.

A by-pass pipe between a hot pipe and a cold pipe of the engine of the invention can be activated or deactivated via a valve in order to effect a rapid decrease or increase in performance corresponding to a decrease or increase in the power produced by the engine of the invention.

FIG. 2 and FIG. 5 show a schematic illustration of the spatial alignment of the shafts 6, 7 and 6', 7' or axes of the cylinders 3, 3', respectively, and the working shaft 105 of the engine of the invention. To achieve a timely transport of the working gas from one cylinder to the other such that the engine of the invention delivers a work output, the axes of the two cylinders are aligned so that they form an isosceles triangle with the axis of the working shaft, from which the engine output is outputtable, and wherein the angle between the legs of the triangle measures approximately 135° and the angle of the hypotenuse and one of the legs measures approximately 22.5°.

The construction and the function of the compensating device of the invention is shown in FIGS. 11 to 20.

In the preferred embodiment of the system of the invention shown in FIGS. 11 to 12A, the compensating device can be discretely adjusted.

As shown in FIGS. 1 and 1A, the compensating device herein is formed by a toothed belt allocated to the shafts of the two units, which belt is mounted for displacement by one or more teeth in order to effect compensation.

As shown in FIG. 2, the compensating device is formed by an anchoring device in which the respective drive shafts for a torque-producing device of the units are stably mounted in various positions, wherein in each of the positions, the gear wheels of the torque-producing device mesh with the corresponding gear wheels on the shafts.

The anchoring device is in turn formed by a gear gearbox in which the respective drive shafts for a torque-producing device of the units are stably mounted in various positions, wherein in each of the positions, the gear wheels of the torque-producing device mesh with the corresponding gear wheels on the shaft.

As shown in FIGS. 12 and 12A, the respective drive shafts for a torque-producing device of the units are aligned relative to each other at a fixed angle of 135°, wherein a corresponding bore hole A, A' is allocated to each shaft for each of these angular alignments. The bore holes B, B' correspond to another angle, which in this case is 120°.

In the preferred embodiment of the system of the invention shown in FIGS. 13 to 15A, the compensating device is continuously adjustable.

The compensating device here is formed by two displaceable rollers disposed between the two torque-producing devices of the two units and driveably connected via a toothed belt to the torque-producing devices, wherein the displaceable rollers are reciprocately displaceable in mutually alterable spacings in a direction perpendicular to the line of connection of the torque-producing devices.

As shown in FIG. 14, a first inlet port of a diametrically opposed first pair of inlet ports of a first cylinder and a first outlet port of a diametrically opposed first pair of outlet ports of the first cylinder are 4° apart from each other, and a second inlet port of the diametrically opposed first pair of inlet ports and a second outlet port of the diametrically opposed first pair of outlet ports are apart from each other at an angular separation of approximately 77°.

As shown in FIG. 14A, a first inlet port of a diametrically opposed second pair of inlet ports of a second cylinder and a first outlet port of a diametrically opposed second pair of outlet ports of the second cylinder are apart from each other at an angular separation of 35°, and a second inlet port of the diametrically opposed second pair of inlet ports and a second outlet port of the diametrically opposed second pair of outlet ports are apart from each other at an angular separation of approximately 47°.

All inlet ports and outlet ports are configured in the cylinder head of a respective cylinder.

The two units are so disposed that a part of the mechanism from which the torque of the rotary piston engine is outputtable, is driven by both units, wherein heating means, a heat storage means and cooling means connected to a pipe system are provided, the inlet ports and the outlet ports of the cylinder displacements of at least one of the cylinders of the units being connected to each other via the pipe system.

Figures 2A, 2B:
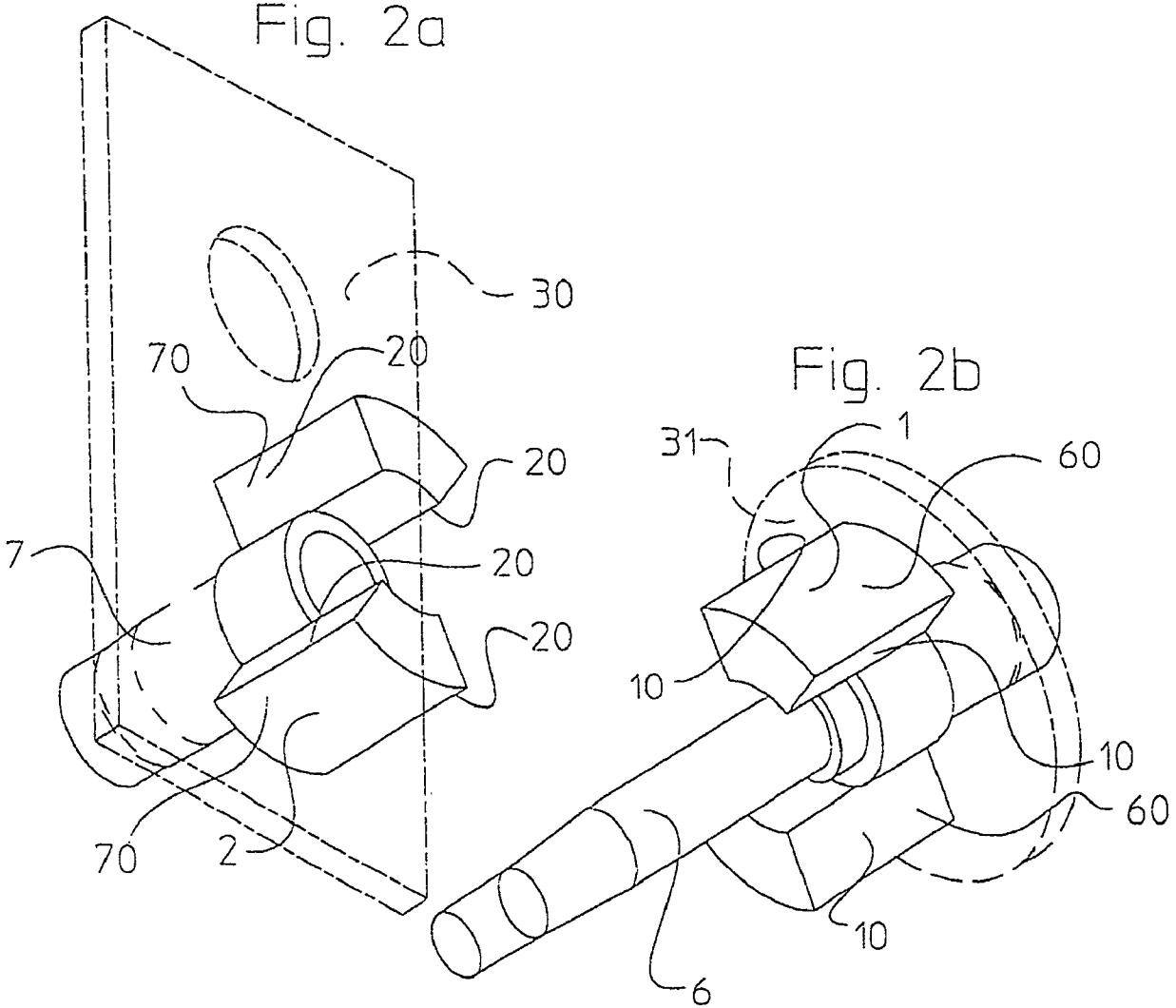

FIG. 16 is a cross sectional view of a temperature unit TA of the preferred embodiment of a discrete-adjusting mechanism of the rotary piston heat engine system of the invention comprising two corresponding temperature units TA, TB. The unit comprises four oval gear wheels, namely the intermeshing oval gear wheels 103, 104 and also the intermeshing oval gear wheels 101, 102. The shaft 6 forms an integral part of the piston 1. The oval gear wheels 102 and 103 are disposed on a shaft 5'. The oval gear wheel 101 is non-rotatably connected to the piston 2, and the oval gear wheel 104 is non-rotatably connected to the piston 1 via the shaft 6. The respective pistons are shown in detail in FIGS. 2*a* and 2*b*. The gear wheels 101, 102, 103 and 104 are housed in a gearbox 28 in such a way that the gear wheels mesh with each other, and the gear wheels 101', 102', 103' and 104' are likewise housed in a gearbox 28' in such a way that the gear wheels mesh with each other.

The work sequence in this case corresponds to that shown in FIGS. 1 to 10, excluding FIG. 2.

FIG. 17 is a rear oblique view of the units I and II, including the compensating device embodied as a belt 120 and including belt wheels 32, 32, of the preferred embodiment shown in FIG. 11 of the discretely adjusting mechanism of the rotary piston heat engine system of the invention, and FIG. 18 is a front view of the units I and II with their respective temperature units TA and TB thermally coupled to each other.

FIG. 18 is a front view of the units I and II with their respective temperature units TA and TB thermally coupled to each other. FIG. 18*a* shows the same units I and II in a top view and FIG. 18*b* is a side view of the same units. In the region of the ports 131, 131'; 141, 141' of a cylinder cover 33 and also the ports 130, 130'; 140, 140' of a cylinder cover 33', the units are connected to each other via gas communication connections 300 and 400 respectively.

FIG. 19 is an exploded view of a unit II of the temperature unit TB of a discretely adjusting mechanism of the rotary piston heat engine system of the invention, and FIG. 20 is an oblique top view of a unit I of a temperature unit TA of a discretely adjusting mechanism of the rotary piston heat engine system of the invention.

The purpose of the exemplary embodiments of the invention explained above is merely to provide a better understanding of the teaching of the invention defined in the claims, which is not, as such, restricted to said exemplary embodiments.

The invention claimed is:

1. A rotary piston heat engine system (100) composed of two units (I, II) each comprising two pistons (1, 2) mounted for movement in opposite directions, the pistons being each mounted for rotation in a cylinder (3, 3'), wherein the longitudinal axes (4, 4') of the pistons (2, 2') and cylinder (3, 3') are collinear, and the pistons (1, 2) are mounted for movement in opposite directions, and a plurality of effective cylinder displacements (8, 9, 11, 12) is formed in each case between two radial boundary surfaces (10, 20) of the two respective pistons (1, 2), which execute an angular motion relative to each other when the engine (100) is operating, and at least one mechanism (110) is provided that superimposes a circular motion on the angular motion of the two pistons (1, 2), and each unit comprises a shaft (6, 6') for driving a torque-producing device (5, 5', 5"), and heating means, heat storage means and cooling means connected to a pipe system are provided, by means of which the inlet ports (130, 130'; 131, 131') and outlet ports (140, 140'; 141, 141') of the displacements of the cylinders (3, 3') of the units (I, II) are connected to each other, wherein a discretely-adjustable compensating device is provided that balances the positions of the respective pistons in the two units (I, II) in the event of a possible phase shift in the synchronization of the two units (I, II), in order to effect an optimal phase response, said compensating device (120) being in the form of a toothed belt disposed around the shaft of the two units (I, II) embodied as torque-producing devices (5', 5"), which belt is mounted for displacement by one or more teeth to effect compensation.

2. A rotary piston heat engine system as defined in claim 1, wherein a first inlet port (130) of a diametrically opposed first pair of inlet ports (130, 130) of a first cylinder (3) and a first outlet port (140) of a diametrically opposed first pair of outlet ports (140, 140) of the first cylinder (3) are separated from each other by 0.5° to 8° and a second inlet port (130) of the diametrically opposed first pair of inlet ports (130, 130) and a second outlet port (140) of the diametrically opposed first pair of outlet ports (140, 140) are separated from each other by an angular distance of approximately 55 to 95°.

3. A rotary piston heat engine system as defined in claim 2, wherein a first inlet port (130) of the diametrically opposed first pair of inlet ports (130, 130) and a first outlet port (140) of the diametrically opposed first pair of outlet ports (140, 140) are separated from each other by 4°.

4. A rotary piston heat engine system as defined in claim 2, wherein a second inlet port (130) of the diametrically opposed first pair of inlet ports (130, 130) and a second outlet port (140) of the diametrically opposed first pair of outlet ports (140, 140) are separated from each other by an angular distance of approximately 77°.

5. A rotary piston heat engine system as defined in claim 1, wherein a first inlet port (131) of a diametrically opposed second pair of inlet ports (131, 131) of a second cylinder (3) and a first outlet port (141) of a diametrically opposed second pair of outlet ports (141, 141) of the second cylinder (3) are separated from each other by an angular distance of approximately 25° to 45° and a second inlet port (131) of the diametrically opposed second pair of inlet ports (131, 131) and a second outlet port (141) of the diametrically opposed second pair of outlet ports (141, 141) are separated from each other by an angular distance of approximately 30° to 60°.

6. A rotary piston heat engine system as defined in claim 5, wherein a first inlet port (131) of the diametrically opposed second pair of inlet ports (131, 131') and a first outlet port (141) of the diametrically opposed second pair of outlet ports (141, 141') are separated from each other by an angular distance of approximately 34°.

7. A rotary piston heat engine system as defined in claim 5, wherein a second inlet port (131) of the diametrically opposed second pair of inlet ports (131, 131'and a second outlet port (141) of the diametrically opposed second pair of outlet ports (141, 141') are separated from each other by an angular distance of approximately 47°.

8. A rotary piston heat engine system as defined in claim 2, wherein all inlet ports and outlet ports in the cylinder head (33; 33') are provided in a respective cylinder (3; 3').

9. A rotary piston heat engine system as defined in claim 1, wherein additionally heat storage means are provided which are connected to the heating means and the cooling means.

10. A rotary piston heat engine system as defined in claim 1, wherein the two units are such that that part of the system (5, 102, 103) from which the torque of the rotary piston engine (100) can be outputted is driven by both units (I, II), and heating means, heat storage means and cooling means in conjunction with a piping system are provided, which piping system connects the inlet ports and outlet ports of the piston displacements of the at least one cylinder (3) of the units (I, II) to each other are.

11. A heat pump comprising a rotary piston heat engine system (100) composed of two units (I, II) each comprising two pistons (1, 2) mounted for movement in opposite directions, the pistons being each mounted for rotation in a cylinder (3, 3'), wherein the longitudinal axes (4, 4') of the pistons (2, 2') and cylinder (3, 3') are collinear, and the pistons (1, 2) are mounted for movement in opposite directions, and a plurality of effective cylinder displacements (8, 9, 11, 12) is formed in each case between two radial boundary surfaces (10, 20) of the two respective pistons (1, 2), which execute an angular motion relative to each other when the engine (100) is operating, and at least one mechanism (110) is provided that superimposes a circular motion on the angular motion of the two pistons (1, 2), and each unit comprises a shaft (6, 6') for driving a torque-producing device (5, 5', 5"), and heating means, heat storage means and cooling means connected to a pipe system are provided, by means of which the inlet ports (130, 130'; 131, 131') and outlet ports (140, 140'; 141, 141') of the displacements of the cylinders (3, 3') of the units (I, II) are connected to each other, wherein a discretely-adjustable compensating device is provided that balances the positions of the respective pistons in the two units (I, II) in the event of a possible phase shift in the synchronization of the two units (I, II), in order to effect an optimal phase response, said compensating device (120) being in the form of a toothed belt disposed around the shaft of the two units (I, II) embodied as torque-producing devices (5', 5"), which belt is mounted for displacement by one or more teeth to effect compensation, wherein rotational energy is supplied to the torque-producing devices (5; 5', 5").

12. A refrigerating system comprising a rotary piston heat engine system (100) composed of two units (I, II) each comprising two pistons (1, 2) mounted for movement in opposite directions, the pistons being each mounted for rotation in a cylinder (3, 3'), wherein the longitudinal axes (4, 4') of the pistons (2, 2') and cylinder (3, 3') are collinear, and the pistons (1, 2) are mounted for movement in opposite directions, and a plurality of effective cylinder displacements (8, 9, 11, 12) is formed in each case between two radial boundary surfaces (10, 20) of the two respective pistons (1, 2), which execute an angular motion relative to each other when the engine (100) is operating, and at least one mechanism (110) is provided that superimposes a circular motion on the angular motion of the two pistons (1, 2), and each unit comprises a shaft (6, 6') for driving a torque-producing device (5, 5', 5"), and heating means, heat storage means and cooling means connected to a pipe system are provided, by means of which the inlet ports (130, 130'; 131, 131') and outlet ports (140, 140'; 141, 141') of the displacements of the cylinders (3, 3') of the units (I, II) are connected to each other, wherein a discretely-adjustable compensating device is provided that balances the positions of the respective pistons in the two units (I, II) in the event of a possible phase shift in the synchronization of the two units (I, II), in order to effect an optimal phase response, said compensating device (120) being in the form of a toothed belt disposed around the shaft of the two units (I, II) embodied as torque-producing devices (5', 5"), which belt is mounted for displacement by one or more teeth to effect compensation, wherein rotational energy is supplied to the torque-producing devices (5; 5', 5").

13. A rotary piston heat engine system (100) composed of two units (I, II) each comprising two pistons (1, 2) mounted for movement in opposite directions, the pistons being each mounted for rotation in a cylinder (3, 3'), wherein the longitudinal axes (4, 4') of the pistons (2, 2') and cylinder (3, 3') are collinear, and the pistons (1, 2) are mounted for movement in opposite directions, and a plurality of effective cylinder displacements (8, 9, 11, 12) is formed in each case between two radial boundary surfaces (10, 20) of the two respective pistons (1, 2), which execute an angular motion relative to each other when the engine (100) is operating, and at least one mechanism (110) is provided that superimposes a circular motion on the angular motion of the two pistons (1, 2), and each unit comprises a shaft (6, 6') for driving a torque-producing device (5, 5', 5"), and heating means, heat storage means and cooling means connected to a pipe system are provided, by means of which the inlet ports (130, 130'; 131, 131') and outlet ports (140, 140'; 141, 141') of the displacements of the cylinders (3, 3') of the units (I, II) are connected to each other, wherein a discretely-adjustable compensating device is provided that balances the positions of the respective pistons in the two units (I, II) in the event of a possible phase shift in the synchronization of the two units (I, II), in order to effect an optimal phase response, said compensating device being embodied as an anchoring system (122), in which the respective shafts (6, 6') of the units (I, II) adapted to drive a torque-producing device (5,) are stably mounted in different positions, and in each of these positions meshing of the gear wheels of the torque-producing device with the respective gear wheels of said shafts is guaranteed.

14. A rotary piston heat engine system as defined in claim 13, wherein the anchoring system is embodied as a gearbox in which the respective shafts (6, 6') of the units adapted to drive a torque-producing device (5; 5', 5") are stably mounted in different positions and in each of these positions meshing of the gear wheels of the torque-producing device with the respective gear wheels on the shafts is assured.

15. A rotary piston heat engine system as defined in claim 13, wherein the anchoring system is in the form of a cover plate in which the respective shafts (6, 6') of the units adapted to drive a torque-producing device (5; 5', 5") are stably mounted in different positions and in each of these positions meshing of the gear wheels of the torque-producing device with the respective gear wheels on the shafts is assured.

16. A rotary piston heat engine system as defined in claim 14, wherein the respective shafts (6, 6') of the units adapted to drive a torque-producing device (5; 5', 5") are disposed relative to each other at a fixed angle of 135 degrees or 125 degrees, there being assigned to each shaft (6, 6') a respective bore A, A'and B, B', respectively, for each of these angular configurations.

17. A rotary piston heat engine system (100) composed of two units (I, II) each comprising two pistons (1, 2) mounted for movement in opposite directions, the pistons being each mounted for rotation in a cylinder (3, 3'), wherein the longitudinal axes (4, 4') of the pistons (2, 2') and cylinder (3, 3') are collinear, and the pistons (1, 2) are mounted for movement in opposite directions, and a plurality of effective cylinder displacements (8, 9, 11, 12) is formed in each case between two radial boundary surfaces (10, 20) of the two respective pistons (1, 2), which execute an angular motion relative to each other when the engine (100) is operating, and at least one mechanism (110) is provided that superimposes a circular motion on the angular motion of the two pistons (1, 2), and each unit comprises a shaft (6, 6') for driving a torque-producing device (5, 5', 5"), and heating means, heat storage means and cooling means connected to a pipe system are provided, by means of which the inlet ports (130, 130'; 131, 131') and outlet ports (140, 140'; 141, 141') of the displacements of the cylinders (3, 3') of the units (I, II) are connected to each other, wherein a continuously-adjustable compensating device is provided that balances the positions of the respective pistons in the two units (I, II) in the event of a possible phase shift in the synchronization of the two units (I, II), in order to effect an optimal phase response, said compensating device being in the form of two displaceable rollers (240, 241) disposed between the two torque-producing devices (5', 5") of the two units (I, II) and are drivingly connected to the torque-producing devices (5', 5") via a toothed belt, which displaceable rollers (240, 241) are reciprocately displaceable over a mutually variable distance in a direction perpendicular to the connecting line of the torque-producing devices (5', 5").

18. A rotary piston heat engine system as defined in claim 17, wherein the two displaceable rollers (240, 241) are in the form of excentric rollers.

* * * * *